US006428947B1

(12) United States Patent
Johnston et al.

(10) Patent No.: US 6,428,947 B1
(45) Date of Patent: Aug. 6, 2002

(54) MULTICOLOR PHOTOGRAPHIC ELEMENT WITH IMPROVED LATENT IMAGE KEEPING

(75) Inventors: Sharon G. Johnston, Pittsford; Annabel A. Muenter; Steven P. Szatynski, both of Rochester; Jerome R. Lenhard, Fairport, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/755,419

(22) Filed: Jan. 5, 2001

(51) Int. Cl.[7] ..... G03C 1/46

(52) U.S. Cl. ..... 430/505; 430/955; 430/598; 430/599; 430/600; 430/603; 430/607; 430/611; 430/613

(58) Field of Search ..... 430/505, 955, 430/598, 599, 600, 603, 607, 611, 613

(56) References Cited

U.S. PATENT DOCUMENTS

| | | | | | |
|---|---|---|---|---|---|
| 4,330,606 | A | | 5/1982 | Sobel et al. | |
| 4,339,515 | A | | 7/1982 | Schranz et al. | |
| 4,378,426 | A | | 3/1983 | Lok et al. | |
| 4,451,557 | A | | 5/1984 | Lok et al. | |
| 4,780,400 | A | | 10/1988 | Beltramini et al. | |
| 5,747,235 | A | | 5/1998 | Farid et al. | |
| 5,747,236 | A | | 5/1998 | Farid et al. | |
| 5,994,051 | A | | 11/1999 | Gould et al. | |
| 6,010,841 | A | | 1/2000 | Farid et al. | |
| 6,027,869 | A | * | 2/2000 | Maskasky et al. | 430/567 |
| 6,054,260 | A | | 4/2000 | Adin et al. | |
| 6,153,371 | A | | 11/2000 | Farid et al. | |
| 6,187,525 | B1 | * | 2/2001 | Maskasky et al. | 430/546 |
| 6,225,036 | B1 | * | 5/2001 | Maskasky et al. | 430/505 |
| 6,242,170 | B1 | * | 6/2001 | Pepe et al. | 430/505 |
| 6,245,497 | B1 | * | 6/2001 | Eikenberry et al. | 430/553 |
| 6,090,536 | A1 | * | 7/2001 | Maskasky et al. | 430/567 |

* cited by examiner

*Primary Examiner*—Geraldine Letscher
(74) *Attorney, Agent, or Firm*—Edith A. Rice

(57) ABSTRACT

This invention comprises multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said red-sensitive or green-sensitive layers comprises a fragmentable electron donating compound of the formula: X—Y' or a compound which contains a moiety of the formula —X—Y';
wherein the speed gain deriving from addition of said compound to said layer is less than or equal to 0.05 log sensitivity units and wherein X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V;
2) the oxidized form of X—Y' undergoes a bond cleavage reaction to give the radical $X^{\cdot}$ and the leaving fragment Y', and
3) the radical $X^{\cdot}$ has an oxidation potential $\leqq -0.7$V.

24 Claims, No Drawings

MULTICOLOR PHOTOGRAPHIC ELEMENT WITH IMPROVED LATENT IMAGE KEEPING

FIELD OF THE INVENTION

This invention relates to a multicolor photographic element having improved latent image keeping and to a method of improving the latent image keeping of a multicolor photographic element.

BACKGROUND OF THE INVENTION

Stability of silver halide color photographic materials under various storage conditions is an important characteristic, particularly for materials designed for use in consumer markets, where storage conditions may be quite variable. One aspect of this stability is stability of the latent image formed on exposure of the material. Instability of the latent image leads to undesirable changes in the photographic speed of the material as a function of storage after exposure but before processing in a photographic developer. This instability can be particularly troublesome in multilayer color photographic materials if the latent image keeping density changes are variable in the different color records of the multicolor element. This variability can lead to mismatches in the speed and curve shape of the color records. Various materials have been disclosed in the prior art for stabilizing the latent image including N-alkynyl benzothiazoliums (U.S. Pat. No. 4,780,400), N-(2-benzoxazolyl) propargyl amines (U.S. Pat. Nos. 4378426 and 4,451,557), 2-hydroxyamino-1,3,5-triazines, hydroxyamic acids (U.S. Pat. Nos. 4339515 and 4,330,606) and the like. A number of these materials have the characteristic that they diffuse throughout the multilayer photographic element so that the latent image keeping characteristics of the different color records cannot be separately adjusted. In addition, many of these materials function better in blue sensitized layers than in red or green sensitized layers. Consequently, achieving good stability of the latent image, especially in green or red sensitized layers, continues to be a problem in practical color multilayer photographic materials.

PROBLEM TO BE SOLVED BY THE INVENTION

It is desirable to find new means to control latent image keeping speed and density changes for multicolor photographic elements. It is particularly desirable to find means that allow the latent image keeping speed and density changes to be adjusted separately in the different color records of the multicolor photographic element.

SUMMARY OF THE INVENTION

One aspect of this invention comprises a multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said red-sensitive or green-sensitive layers comprises a fragmentable electron donating compound of the formula: X—Y' or a compound which contains a moiety of the formula —X—Y';

wherein the speed gain deriving from addition of said compound to said layer is less than or equal to 0.05 log sensitivity units and wherein X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V;
2) the oxidized form of X—Y' undergoes a bond cleavage reaction to give the radical $X^{\cdot}$ and the leaving fragment Y'; and
3) the radical $X^{\cdot}$ has an oxidation potential $\leqq -0.7$V (that is, equal to or more negative than about −0.7V).

Another aspect of this invention comprises a method of improving the latent image keeping of a multilayer photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein for at least one of said red-sensitive or green-sensitive layers, said method comprises adding a fragmentable electron donating compound of the formula: X—Y' or a compound which contains a moiety of the formula —X—Y', in an amount sufficient to improve the latent image keeping but insufficient to impart a speed gain deriving from addition of said compound to said layer of more than 0.05 log sensitivity units and wherein X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V;
2) the oxidized form of X—Y' undergoes a bond cleavage reaction to give the radical $X^{\cdot}$ and the leaving fragment Y'; and,
3) the radical $X^{\cdot}$ has an oxidation potential $\leqq -0.7$V.

ADVANTAGEOUS EFFECT OF THE INVENTION

This invention provides a multicolor photographic element having little speed or density loss with latent image keeping and latent image keeping characteristics that are well matched between the different color records.

DETAILED DESCRIPTION OF THE INVENTION

We have found that addition of a small amount of fragmentable two-electron donor to the emulsion layers of a multilayer color photographic element can significantly improve the latent image stability of the material. Fragmentable two electron donors (FED's) are compounds that have been designed to improve the speed of photographic materials by providing two electrons for each photon absorbed by the silver halide emulsion. Fragmentable electron donating compounds are described in U.S. Pat. Nos. 5,747,235 and 5,747,236 and 5,994,051, 6,010,841, 6,054,260 and 6,153,371, the entire disclosures thereof are incorporated herein by reference. These references disclose speed gains associated with the use of fragmentable two-electron donors in a wide variety of silver halide emulsions. Surprisingly, we have found that, particularly for green and red sensitized emulsions, latent image can be stabilized by use of an amount of fragmentable two-electron donor that gives little or no speed gain when added to the emulsion layer. When the fragmentable two-electron donor is a moiety attached to a silver halide absorptive group or to a sensitizing dye, the additional advantage is obtained that latent image keeping changes can be controlled independently in the different color records of the multicolor element. Independent control of latent image keeping changes in the different layers (fast, mid, or slow) of a given color record is also possible.

One aspect of this invention comprises a multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said red-sensitive or green-sensitive layers comprises a fragmentable electron donating compound of the formula: X—Y' or a compound which contains a moiety of the formula —X—Y';

wherein the speed gain deriving from addition of said compound to said layer is less than or equal to 0.05 log sensitivity units and wherein X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V;
2) the oxidized form of X—Y' undergoes a bond cleavage reaction to give the radical $X^{\cdot}$ and the leaving fragment Y'; and
3) the radical $X^{\cdot}$ has an oxidation potential $\leqq -0.7$V (that is, equal to or more negative than about −0.7V).

In this patent application, oxidation potentials are reported as "V" which represents "volts versus a saturated calomel reference electrode".

In embodiments of the invention in which Y' is Y, the following represents the reactions are believed to take place when X—Y undergoes oxidation and fragmentation to produce a radical $X^{\cdot}$, which then undergoes further oxidation.

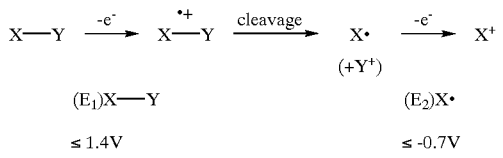

where $E_1$ is the oxidation potential of X—Y and $E_2$ is the oxidation potential of the radical $X^{\cdot}$.

$E_1$ is preferably no higher than about 1.4 V and preferably less than about 1.0 V. The oxidation potential is preferably greater than 0, more preferably greater than about 0.3 V. $E_1$ is preferably in the range of about 0 to about 1.4 V, and more preferably from about 0.3 V to about 1.0 V.

In this invention the oxidation potential, $E_2$, of the radical $X^{\cdot}$ is equal to or more negative than −0.7V, preferably more negative than about −0.9 V. $E_2$ is preferably in the range of from about −0.7 to about −2 V, more preferably from about −0.8 to about −2 V and most preferably from about −0.9 to about −1.6 V.

The structural features of X—Y are defined by the characteristics of the two parts, namely the fragment X and the fragment Y. The structural features of the fragment X determine the oxidation potential of the X—Y molecule and that of the radical $X^{\cdot}$, whereas both the X and Y fragments affect the fragmentation rate of the oxidized molecule $X—Y^{\cdot+}$.

In embodiments of the invention in which Y' is H, the following represents the reactions believed to take place when the compound X—H undergoes oxidation and deprotonation to the base, $\beta^-$, to produce a radical $X^{\cdot}$, which in a preferred embodiment undergoes further oxidation.

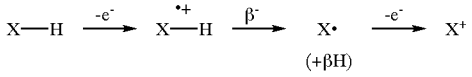

As mentioned above, the base $\beta^-$ is present in the emulsion. It is specifically contemplated that the base $\beta^-$ can be in the emulsion by virtue of being covalently linked to X.

Preferred X groups are of the general formula:

(I)

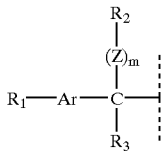

(II)

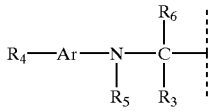

(III)

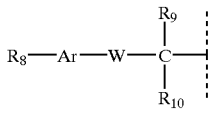

or (IV)

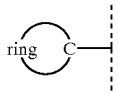

The symbol "R" (that is R without a subscript) is used in all structural formulae in this patent application to represent a hydrogen atom or an unsubstituted or substituted alkyl group.

In structure (I):

m=0, 1;

Z=O, S, Se, Te;

Ar=aryl group (e.g., phenyl, naphthyl, phenanthryl, anthryl); or heterocyclic group (e.g., pyridine, indole, benzimidazole, thiazole, benzothiazole, thiadiazole, etc.);

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, Ar';

$R_3$=R, Ar';

$R_2$ and $R_3$ together can form 5- to 8-membered ring;

$R_2$ and Ar=can be linked to form 5- to 8-membered ring;

$R_3$ and Ar=can be linked to form 5- to 8-membered ring;

Ar'=aryl group such as phenyl, substituted phenyl, or heterocyclic group (e.g., pyridine, benzothiazole, etc.)

R=a hydrogen atom or an unsubstituted or substituted alkyl group.

In structure (II):

Ar=aryl group (e.g., phenyl, naphthyl, phenanthryl); or heterocyclic group (e.g., pyridine, benzothiazole, etc.);

$R_4$=a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, $SO_2R$, SOR, C(S)R, etc;

$R_5$=R, Ar'

$R_6$ and $R_7$=R, Ar'

$R_5$ and Ar=can be linked to form 5- to 8-membered ring;

$R_6$ and Ar=can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar'=aryl group such as phenyl, substituted phenyl, heterocyclic group;

R=hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (III):

W=O, S, Se;

Ar=aryl group (e.g., phenyl, naphthyl, phenanthryl, anthryl); or heterocyclic group (e.g., indole, benzimidazole, etc.)

$R_8$=R, carboxyl, $NR_2$, $(OR)_n$, or $(SR)_n$ (n=1–3);

$R_9$ and $R_{10}$=R, Ar';

$R_9$ and Ar=can be linked to form 5- to 8-membered ring;

Ar'=aryl group such as phenyl substituted phenyl or heterocyclic group;

R=a hydrogen atom or an unsubstituted or substituted alkyl group.

In structure (IV):

"ring" represents a substituted or unsubstituted 5-, 6- or 7-membered unsaturated ring, preferably a heterocyclic ring.

The following are illustrative examples of the group X of the general structure I:

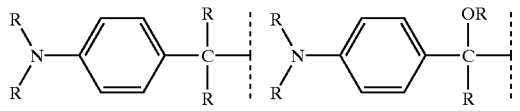

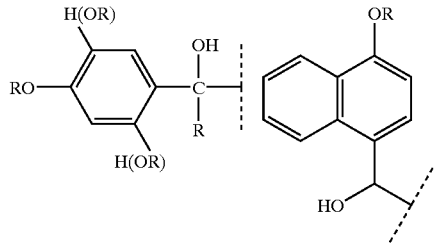

-continued

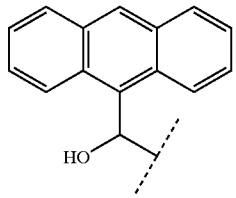

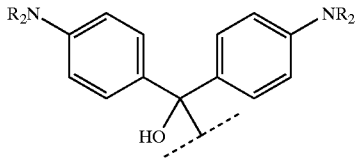

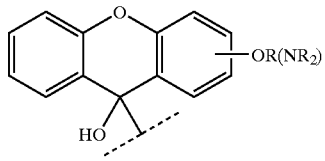

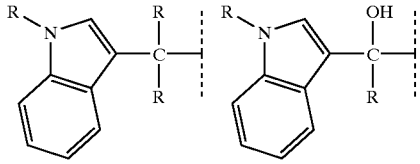

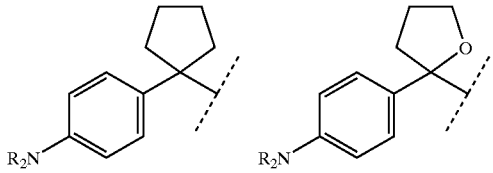

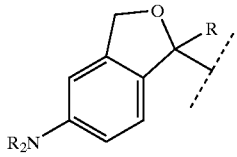

In the structures of this patent application a designation such as —OR($NR_2$) indicates that either —OR or —$NR_2$ can be present.

The following are illustrative examples of the group X of general structure

II:

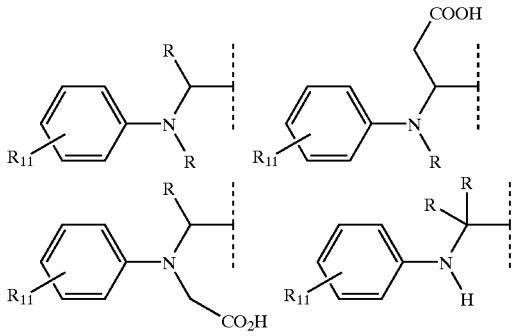

-continued

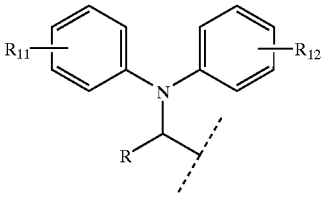

$R_{11}$ and $R_{12}$ = { H, alkyl, alkoxy, alkylthio, halo, carbamoyl; carboxyl, amido, formyl, sulfonyl, sulfonamido, nitrile }

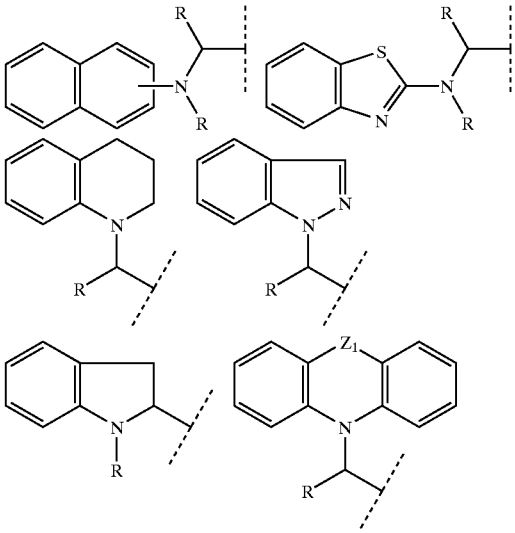

$Z_1$=a covalent bond, S, O, Se, NR, $CR_2$, CR═CR, or $CH_2CH_2$.

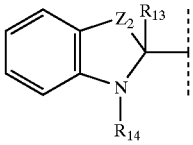

$Z_2$=S, O, Se, NR, $CR_2$, CR═CR, $R_{13}$,=alkyl, substituted alkyl or aryl, and $R_{14}$=H, alkyl substituted alkyl or aryl.

The following are illustrative examples of the group X of the general structure III:

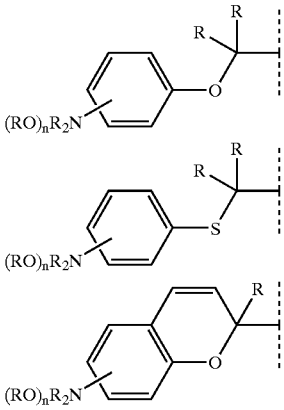

-continued

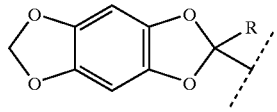

n = 1–3

The following are illustrative examples of the group X of the general structure IV:

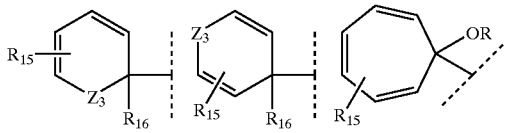

$Z_3$ = O, S, Se, NR
$R_{15}$ = R, OR, $NR_2$
$R_{16}$ = alkyl, substituted alkyl Preferred Y' groups are:

(1) X', where X' is an X group as defined in structures I–IV and may be the same as or different from the X group to which it is attached (2) —$coo^-$ (3) —$M(R')_3$ where M=Si, Sn or Ge; and R'=alkyl or substituted alkyl (4) —$B^-(Ar'')_3$ where Ar"=aryl or substituted aryl (5) —H In preferred embodiments of this invention Y' is —H, —$COO^-$ or —$Si(R')_3$ or —X'. Particularly preferred Y' groups are —H, —$COO^-$ or —$Si(R')_3$.

In embodiments of the invention in which Y' is a proton, a base, $\beta^-$, is present in the emulsion layer and may be covalently linked directly or indirectly to X. The base is preferably the conjugate base of an acid of pKa between about 1 and about 8, preferably about 2 to about 7. Collections of pKa values are available (see, for example: Dissociation Constants of Organic Bases in Aqueous Solution, D. D. Perrin (Butterworths, London, 1965), CRC Handbook of Chemistry and Physics, 77th ed, D. R. Lide (CRC Press, Boca Raton, Fla., 1996)). Examples of useful bases are included in Table I.

TABLE I

| pKa's in water of the conjugate acids of some useful bases | |
|---|---|
| $CH_3$—$CO_2^-$ | 4.76 |
| $C_2H_5$—$CO_2^-$ | 4.87 |
| $(CH_3)_2CH$—$CO_2^-$ | 4.84 |
| $(CH_3)_3C$—$CO_2^-$ | 5.03 |
| HO—$CH_2$—$CO_2^-$ | 3.83 |
| 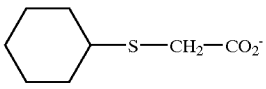 | 3.48 |
| $CH_3$—CO—NH—$CH_2$—$CO_2^-$ | 3.67 |
| 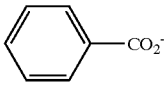 | 4.19 |

TABLE I-continued

| pKa's in water of the conjugate acids of some useful bases | |
|---|---|
| 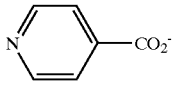 | 4.96 |
| $CH_3—COS^-$ | 3.33 |
| 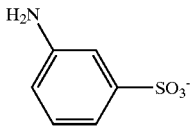 | 3.73 |
| 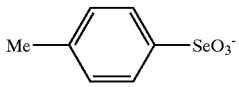 | 4.88 |
| 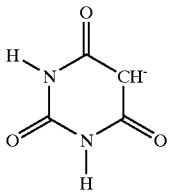 | 4.01 |
| 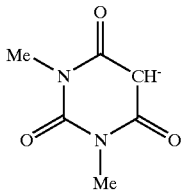 | 4.7 |
| $(CH_3)_3\overset{+}{N}—\overset{-}{O}$ | 4.65 |
| 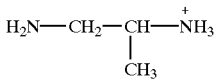 | 6.61 |
| 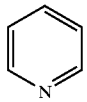 | 5.25 |
| 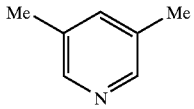 | 6.15 |

TABLE I-continued

| pKa's in water of the conjugate acids of some useful bases | |
|---|---|
| 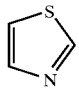 | 2.44 |
| 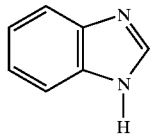 | 5.53 |

Preferably the base, $\beta^-$ is a carboxylate, sulfate or amine oxide.

In preferred embodiments of the invention, the fragmentable electron donating compound contains a light absorbing group, Z, which is attached directly or indirectly to X, a silver halide absorptive group, A, directly or indirectly attached to X, or a chromophore forming group, Q, which is attached to X. Such fragmentable electron donating compounds are preferably of the following formulae:

$$Z—(L—X—Y')_k \quad A—(L—X—Y')_k$$

$$(A—L)_k—X—Y' \quad Q—X—Y' \quad A—(X—Y')_k$$

$$(A)_k—X—Y' \quad Z—(X—Y')_k \text{ or } (Z)_k—X—Y'$$

Z is a light absorbing group;

k is 1 or 2;

A is a silver halide adsorptive group that preferably contains at least one atom of N, S, P, Se, or Te that promotes adsorption to silver halide;

L represents a linking group containing at least one C, N, S, P or O atom; and

Q represents the atoms necessary to form a chromophore comprising an amidinium-ion, a carboxyl-ion or dipolar-amidic chromophoric system when conjugated with X—Y'.

Z is a light absorbing group including, for example, cyanine dyes, complex cyanine dyes, merocyanine dyes, complex merocyanine dyes, homopolar cyanine dyes, styryl dyes, oxonol dyes, hemioxonol dyes, and hemicyanine dyes.

Preferred Z groups are derived from the following dyes:

Dye 1

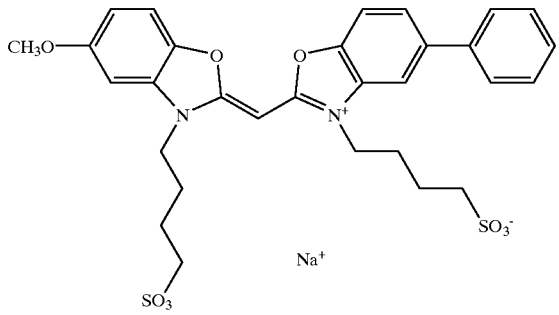

-continued
Dye 2
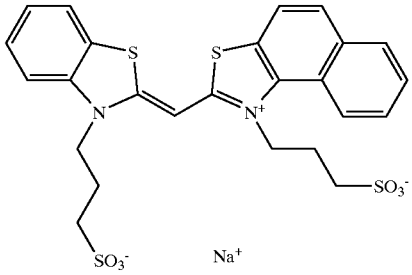
Dye 3
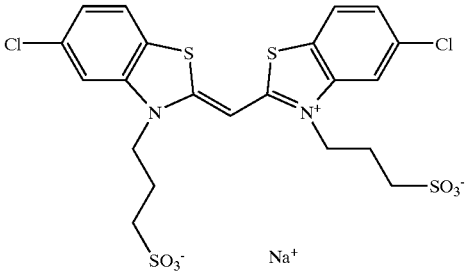
Dye 4
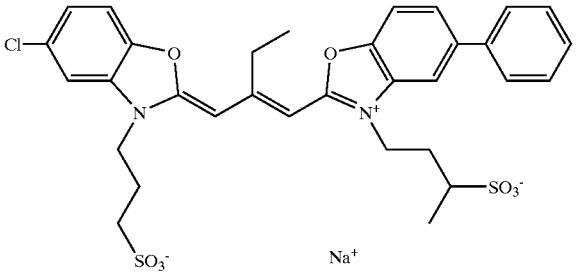
Dye 5
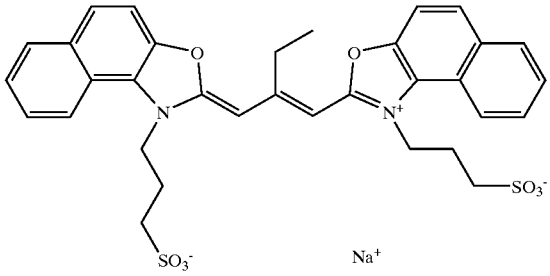
Dye 6
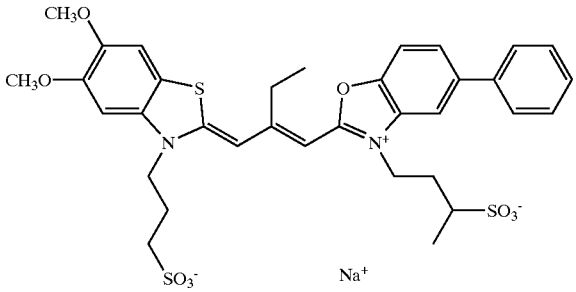

-continued

Dye 7

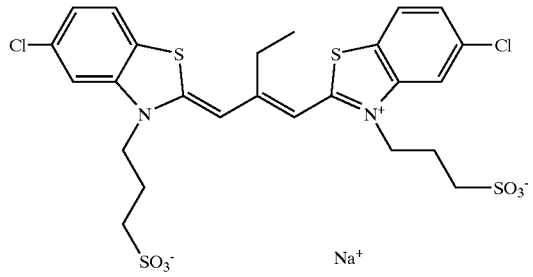

and

Dye 8

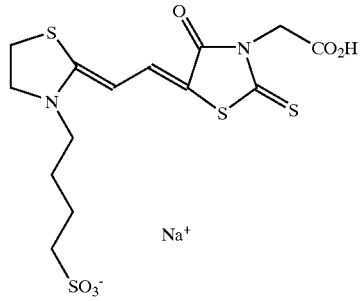

The linking group L may be attached to the dye at one (or more) of the heteroatoms, at one (or more) of the aromatic or heterocyclic rings, or at one (or more) of the atoms of the polymethine chain. For simplicity, and because of the multiple possible attachment sites, the attachment of the L group is not specifically indicated in the generic structures.

The silver halide adsorptive group A is preferably a silver-ion ligand moiety or a cationic surfactant moiety. In preferred embodiments, A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

Illustrative A groups include:

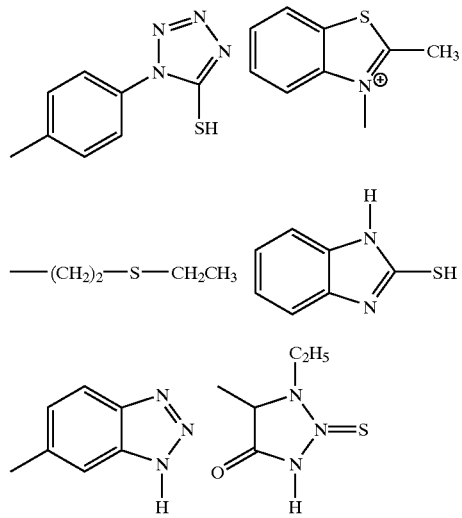

-continued

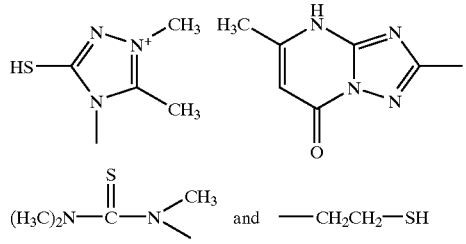

The point of attachment of the linking group L to the silver halide adsorptive group A will vary depending on the structure of the adsorptive group, and may be at one (or more) of the heteroatoms, at one (or more) of the aromatic or heterocyclic rings.

The linkage group represented by L which connects the light absorbing group to the fragmentable electron donating group XY by a covalent bond is preferably an organic linking group containing a least one C, N, S, or O atom. It is also desired that the linking group not be completely aromatic or unsaturated, so that a pi-conjugation system cannot exist between the Z and XY moieties. Preferred examples of the linkage group include, an alkylene group, an arylene group, —O—, —S—, —C═O, —$SO_2$—, —NH—, —P═O, and —N═. Each of these linking components can be optionally substituted and can be used alone or in combination. Examples of preferred combinations of these groups are:

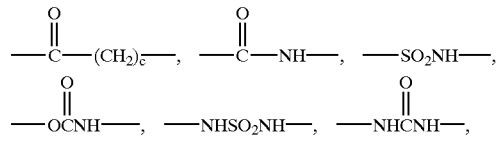

-continued $$-(CH_2)_cC(=O)NH-,\quad -C(=O)-O-,$$

$$-(\text{arylene})-NHC(=O)NH-,\quad -(\text{arylene})-C(=O)NH-,$$

$$-(OCH_2CH_2)_d-$$

where c = 1–30, and d = 1–10

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general formulae indicated below:

$$-(CH_2)_e-N(CH_3)-(CH_2)_f-$$

$$-(CH_2)_e-SO_2-NH-(CH_2)_f-$$

$$-(CH_2)_e-O-(CH_2)_f-$$

$$-(CH_2)_e-CO-NH-(CH_2)_f-$$

$$-(CH_2)_e-C(=O)-O-(CH_2)_f-\quad -(CH_2)_e-$$

e and f = 1–30, with the proviso that e + f ≤ 31

Q represents the atoms necessary to form a chromophore comprising an amidinium-ion, a carboxyl-ion or dipolar-amidic chromophoric system when conjugated with X—Y'. Preferably the chromophoric system is of the type generally found in cyanine, complex cyanine, hemicyanine, merocyanine, and complex merocyanine dyes as described in F. M. Hamer, *The Cyanine Dyes and Related Compounds* (Interscience Publishers, New York, 1964).

Illustrative Q groups include:

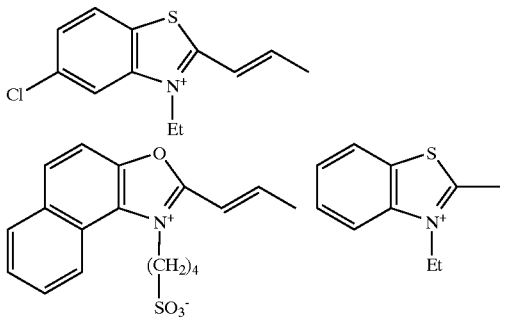

-continued

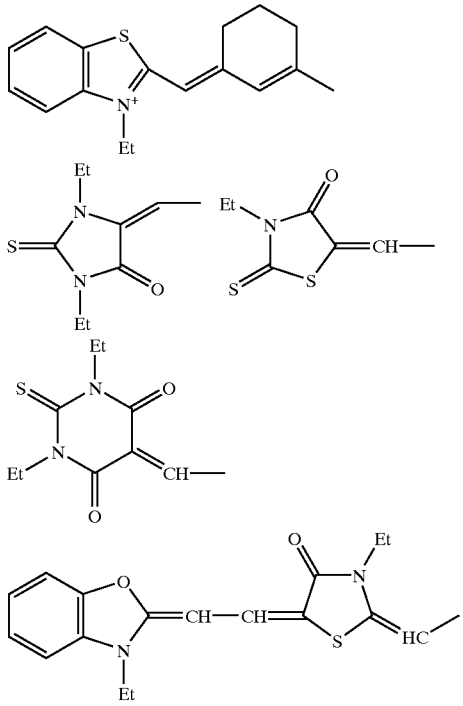

Particularly preferred are Q groups of the formula:

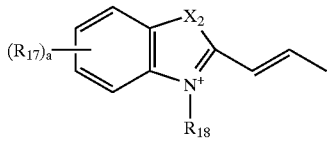

wherein:

$X_2$ is O, S, N, or $C(R_{19})_2$, where $R_{19}$ is substituted or unsubstituted alkyl.

each $R_{17}$ is independently a hydrogen atom, a halogen atom, a substituted or unsubstituted alkyl group, or substituted or unsubstituted aryl group, a is an integer of 1–4;

and $R_{18}$ is substituted or unsubstituted alkyl, or substituted or unsubstituted aryl.

Illustrative fragmentable electron donating compounds include:

FED 1

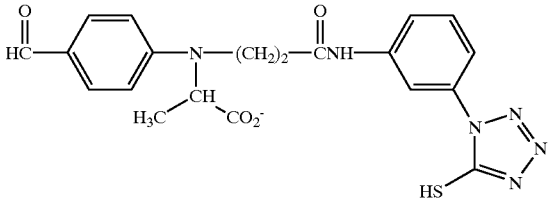

-continued
FED 2
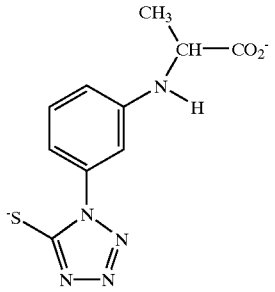
FED 3
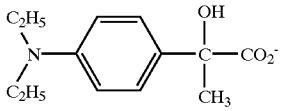
FED 4
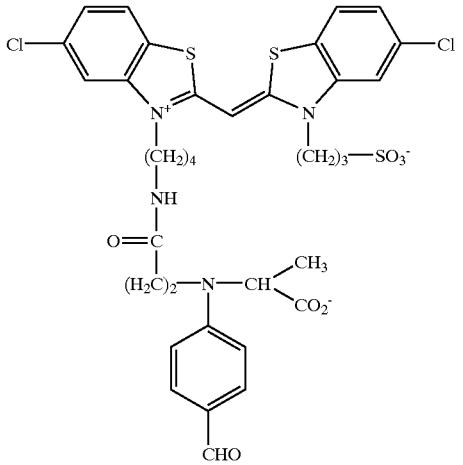
FED 5
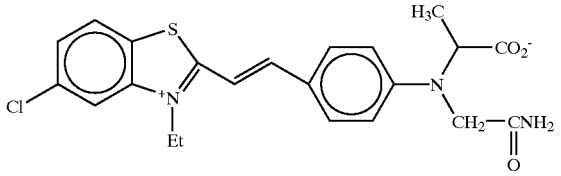
FED 6
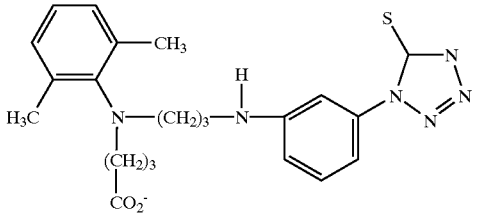
FED 7
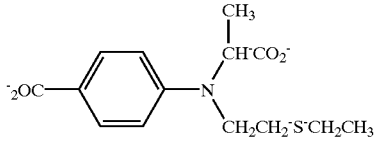
FED 8
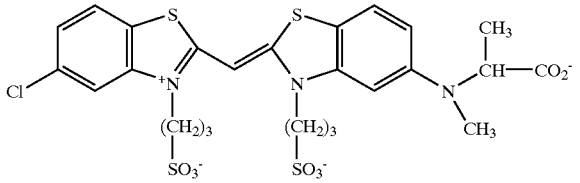

-continued
FED 9
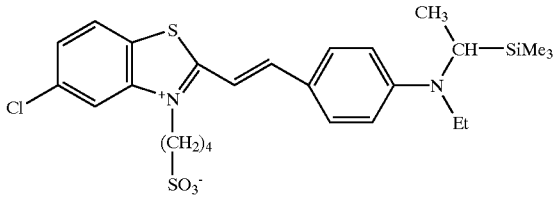
FED 10
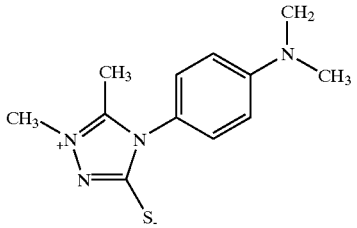
FED 11
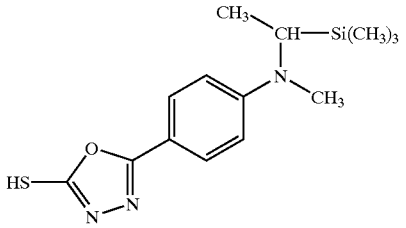
FED 12
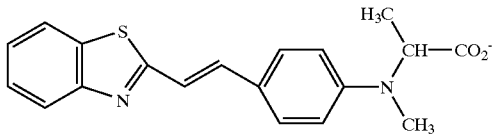
FED 13
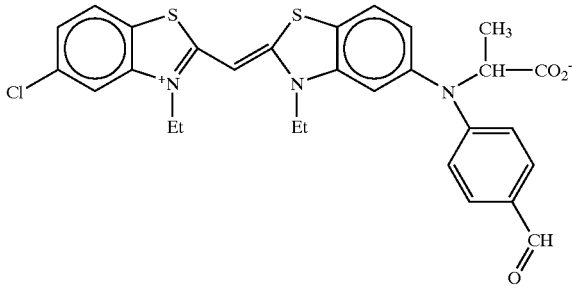
FED 14
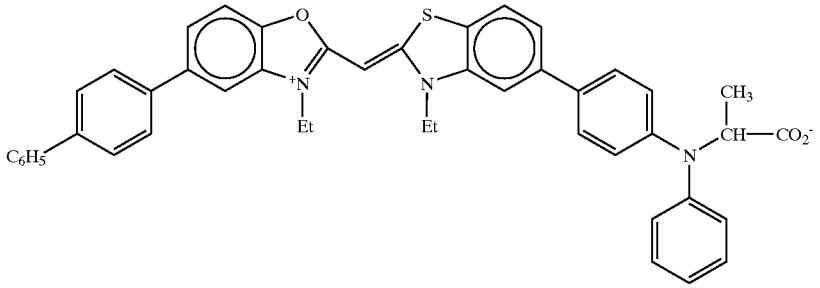

-continued
FED 15
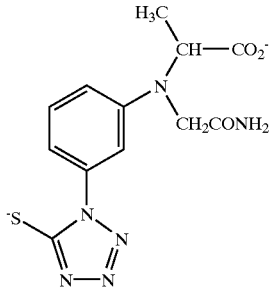
FED 16
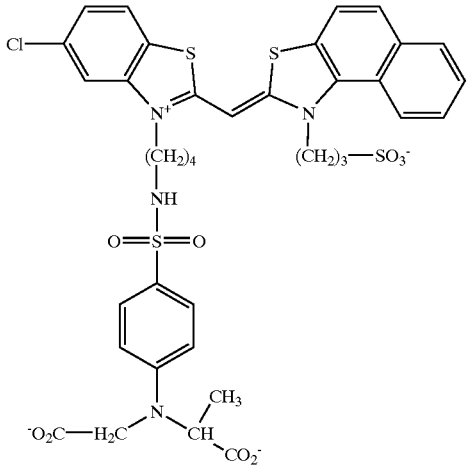
FED 18
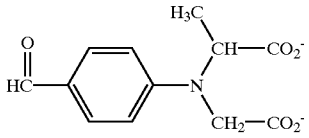
FED 19
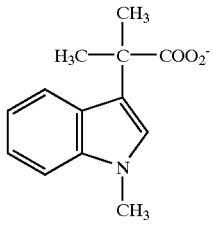
FED 20
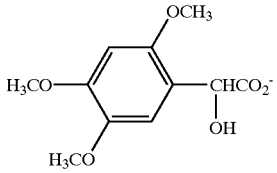

-continued

FED 21

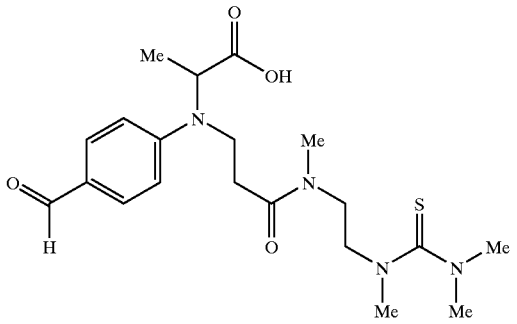

FED 22

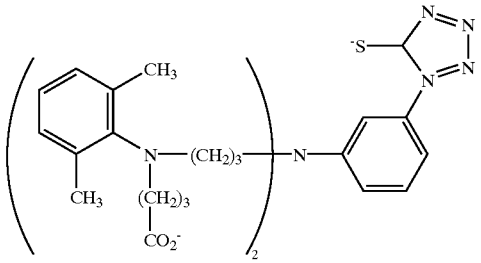

FED 23

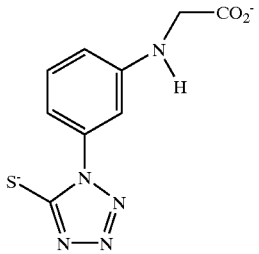

FED 24

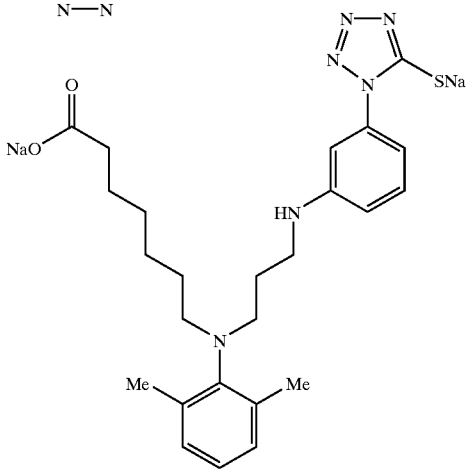

Fragmentable electron donating compounds are described more fully in U.S. Pat. Nos. 5,747,235 and 5,747,236 and 5,994,051, 6,010,841, 6,054,260 and 6,153,371, the entire disclosures thereof are incorporated herein by reference.

In addition, it is also contemplated to use protected fragmentable electron donors in the practice of this invention. Protected fragmentable electron donors comprise compounds of formula (a), (b) or (c):

$$\Delta—(t)_m—XY' \quad (a)$$

$$XY'—(t)_m—\Delta \quad (b)$$

$$\Delta—(t)_m—XY'—(t)_m—\Delta \quad (c)$$

wherein Δ is protective group that is eliminated in the coating environment, t is a timing group, m is an integer from 0 to 3, and XY' is a fragmentable electron donor moiety in which X is an electron donor group and Y' is a leaving proton H or a leaving group Y, with the proviso that if Y' is a proton, a base, $\beta^-$ is present in the emulsion or is covalently linked directly or indirectly to X, and XY' is a fragmentable electron donor moiety as defined above.

The protective group Δ is eliminated by components in the coating environment such as hydroxyl ion. The scission mechanism thereof includes, for example, a direct scission, such as intermolecular nucleophilic substitution reaction or elimination reaction, and an indirect breaking, such as intermolecular addition reaction or intramolecular nucleophilic substitution reaction. Examples of the protective group represented by Δ include a group cleaving on hydrolysis (e.g., acyl group, sulfonyl group, sulfinyl group, aminomethyl group), a group cleaving on reverse Michael addition reaction (e.g., 2-cyanoethyl group, 2-acylethyl group, 2-sulfonylethyl group, 2-carbamoylethyl group, pyrrolidine-2,5-dioxo-3-yl group), a group cleaving on intramolecular nucleophilic substitution reaction, a group blocked with a phthalide group or a saccharin group and a group blocked with an imidomethyl group. Protected fragmentable electron donor compounds are described more fully in co-pending application U.S. Serial No. 09/750,855 filed Dec. 28, 2000, the disclosure of which is incorporated here by reference.

The fragmentable electron donating sensitizer compounds of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion.

The amount of fragmentable electron donating compound which is employed in this invention may range from as little as $1\times10^{-9}$ mole to as much as about 0.1 mole per mole of silver in an emulsion layer, preferably from as little as $5\times10^{-9}$ mole to as much as about 0.01 mole per mole of silver in an emulsion layer. Where the oxidation potential $E_1$ for the XY moiety of the electron donating compound is a relatively low potential, it is more active, and relatively less of the FED compound need be employed. Conversely, where the oxidation potential for the XY moiety of the electron donating compound is relatively high, a larger amount thereof, per mole of silver, is employed. In addition, for XY moieties that have silver halide adsorptive groups A or light absorptive groups Z or chromophoric groups Q directly or indirectly attached to X, the fragmentable electron donating compound is more closely associated with the silver halide grain and relatively less of the FED compound need be employed. In any case, for the practice of this invention in green and red sensitized layers of a multicolor film element, the amount of fragmentable electron donating compound to be used must be adjusted to give a speed gain that is less than or equal to 0.05 log sensitivity units.

Various compounds may be added to the photographic material of the present invention for the purpose of lowering the fogging of the material during manufacture, storage, or processing. Typical antifoggants are discussed in Section VI of Research Disclosure Sep. 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire PO10 7DQ, ENGLAND., Such antifoggants include, for example tetraazaindenes, mercaptotetrazoles, polyhydroxybenzenes, hydroxyaminobenzenes, combinations of a thiosulfonate and a sulfinate, and the like.

For this invention, polyhydroxybenzene and hydroxyaminobenzene compounds (hereinafter "hydroxybenzene compounds") are preferred as they are effective for lowering fog without decreasing the emulsion sensitvity. Examples of hydroxybenzene compounds are:

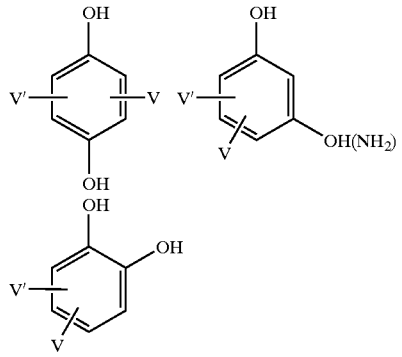

In these formulae, V and V' each independently represent —H, —OH, a halogen atom, —OM (M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, they each independently represent —H, —OH, —Cl, —Br, —COOH, $—CH_2CH_2COOH$, $—CH_3$, $—CH_2CH_3$, $—C(CH_3)_3$, $—OCH_3$, —CHO, $—SO_3K$, $—SO_3Na$, $—SO_3H$, $—SCH_3$, or -phenyl.

Especially preferred hydroxybenzene compounds follow:

HB1

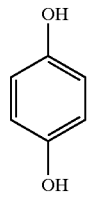

HB2

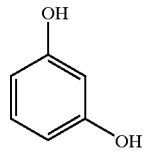

HB3

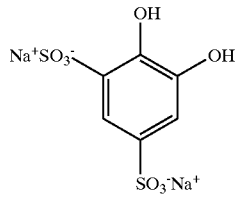

HB4

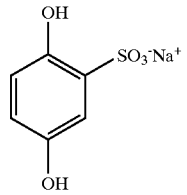

-continued

HB5

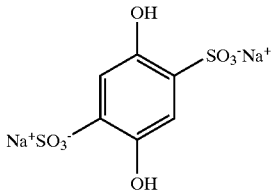

HB6

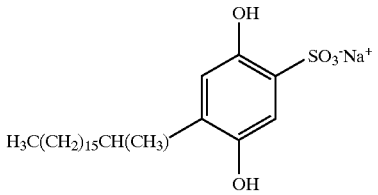

HB7

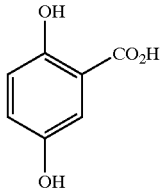

HB8

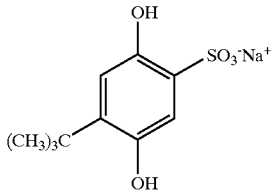

HB9

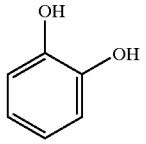

HB10

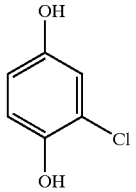

HB11

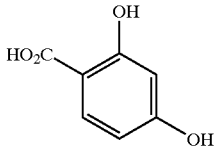

HB12

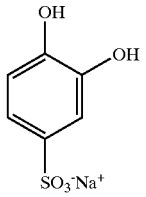

-continued

HB13

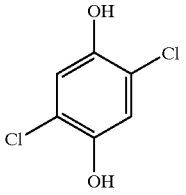

HB14

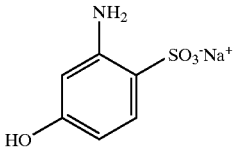

HB15

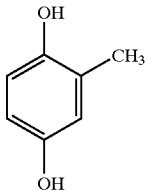

Hydroxybenzene compounds may be added to the emulsion layers or any other layers constituting the photographic material of the present invention. The preferred amount added is from $1\times10^{-3}$ to $1\times10^{-1}$ mol, and more preferred is $1\times10^{-3}$ to $2\times10^{-2}$ mol, per mol of silver halide.

The emulsion layer of the photographic element of the invention can comprise any one or more of the light sensitive layers of the photographic element. The photographic elements made in accordance with the present invention are multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which is preferably transparent.

Image dye forming couplers that can be used in the multilayer photographic element of the incention include, for example:

Couplers which combine with oxidized developer to produce cyan colored dyes are shown, for example, in Weissberger et al U.S. Pat. No. 2,474,293, Vittum et al U.S. Pat. No. 3,002,836, Stecker U.S. Pat. No. 3,041,236, Ono et al U.S. Pat. No. 4,746,602, Kilminster U.S. Pat. No. 4,753,871, Aoki et al U.S. Pat. No. 4,770,988, Kilminster et al U.S. Pat. No. 4,775,616, Hamada et al U.S. Pat. No. 4,818,667, Masukawa et al U.S. Pat. No. 4,818,672, Monbaliu et al U.S.

Pat. No. 4,822,729, Monbaliu et al U.S. Pat. No. 4,839,267, Masukawa et al U.S. Pat. No. 4,840,883, Hoke et al U.S. Pat. No. 4,849,328, Miura et al U.S. Pat. No. 4,865,961, Tachibana et al U.S. Pat. No. 4,873,183, Shimada et al U.S. Pat. No. 4,883,746, Tani et al U.S. Pat. No. 4,900,656, Ono et al U.S. Pat. No. 4,904,575, Tachibana et al U.S. Pat. No. 4,916,051, Nakayama et al U.S. Pat. No. 4,921,783, Merkel et al U.S. Patent 4,923,791, Tachibaba et al U.S. Pat. No. 4,950,585, Aoki et al U.S. Pat. No. 4,971,898, Lau U.S. Pat. No. 4,990,436, Masukawa et al U.S. Pat. No. 4,996,139, Merkel U.S. Pat. No. 5,008,180, Wolff U.S. Pat. No. 5,015, 565, Tachibana et al U.S. Pat. No. 5,011,765, Kida et al U.S. Pat. No. 5,011,766, Masukawa et al U.S. Pat. No. 5,017,467, Hoke U.S. Pat. No. 5,045,442, Uchida et al U.S. Pat. No. 5,051,347, Kaneko U.S. Pat. No. 5,061,613, Kitaet al U.S. Pat. No. 5,071,737, Langen et al U.S. Pat. No. 5,075,207, Fukunada et al U.S. Pat. No. 5,091,297, Tsukahara et al U.S. Pat. No. 5,094,938, Shimada et al U.S. Pat. No. 5,104,783, Fujita et al U.S. Pat. No. 5,178,993, Naito et al U.S. Pat. No. 5,813,729, Ikesu et al U.S. Pat. No. 5,187,057, Tsukahara et al U.S. Pat. No. 5,192,651, Schumann et al U.S. Pat. No. 5,200,305, Yamakawa et al U.S. Pat. No. 5,202,224, Shimada et al U.S. Pat. No. 5,206,130, Ikesu et al U.S. Pat. No. 5,208,141, Tsukahara et al U.S. Pat. No. 5,210,011, Sato et al U.S. Pat. No. 5,215,871, Kita et al U.S. Pat. No. 5,223, 386, Sato et al U.S. Pat. No. 5,227,287, Suzuki et al U.S. Pat. No. 5,256,526, Kobayashi et al U.S. Pat. No. 5,258,270, Shimada et al U.S. Pat. No. 5,272,051, Ikesu et al U.S. Pat. No. 5,306,610, Yamakawa U.S. Pat. No. 5,326,682, Shimada et al U.S. Pat. No. 5,366,856, Naruse et al U.S. Pat. No. 5,378,596, Takizawa et al U.S. Pat. No. 5,380,638, Lau et al U.S. Pat. No. 5,382,502, Matsuoka et al U.S. Pat. No. 5,384,236, Takada et al U.S. Pat. No. 5,397,691, Kaneko et al U.S. Pat. No. 5,415,990, Asami U.S. Pat. No. 5,434,034, Tang et al U.S. Pat. No. 5,441,863, Tashiro et al EPO 0 246 616, Lau EPO 0 250 201, Kilminster et al EPO 0 271 323, Sakanoue et al EPO 0 295 632, Mihayashi et al EPO 0 307 927, Ono et al EPO 0 333 185, Shinba et al EPO 0 378 898, Giusto EPO 0 389 817, Sato et al EPO 0 487 111, Suzuki et al EPO 0 488 248, Ikesu et al EPO 0 539 034, Suzuki et al EPO 0 545 300, Yamakawa et al EPO 0 556 700, Shimada et al EPO 0 556 777, Kawai EPO 0 556 858, Yoshioka EPO 0 569 979, Ikesu et al EPO 0 608 133, Merkel et al EPO 0 636 936, Merkel et al EO 0 651 286, Sugita et al EPO 0 690 344, Renner et al German OLS 4,026,903, Langen et al German OLS 3,624,777 and Wolff et al German OLS 3,823,049, Magenta coupler types are shown, for example, in Porter et al U.S. Pat. Nos. 2,311,082 and 2,369,489, Tuite U.S. Pat. No. 3,152,896, Arai et al U.S. Pat. No. 3,935,015, Renner U.S. Pat. No. 4,745,052, Ogawa et al U.S. Pat. No. 4,762,775, Kida et al U.S. Pat. No. 4,791,052, Wolff et al U.S. Pat. No. 4,812,576, Wolff et al U.S. Pat. No. 4,835,094, Abe et al U.S. Pat. No. 4,840,877, Wolff U.S. Pat. No. 4,845,022, Krishnamurthy et al U.S. Pat. No. 4,853,319, Renner U.S. Pat. No. 4,868,099, Helling et al U.S. Pat. No. 4,865,960, Normandin U.S. Pat. No. 4,871,652, Buckland U.S. Pat. No. 4,876,182, Bowne et al U.S. Pat. No. 4,892, 805, Crawley et al U.S. Pat. No. 4,900,657, Furutachi U.S. Pat. No. 4,910,124, Ikesu et al U.S. Pat. No. 4,914,013, Yokoyama et al U.S. Pat. No. 4,921,968, Furutachi et al U.S. Pat. No. 4,929,540, Kim et al U.S. Pat. No. 4,933,465, Renner U.S. Pat. No. 4,942,116, Normandin et al U.S. Pat. No. 4,942,117, Normandin et al U.S. Pat. No. 4,942,1 18, Normandin et al U.S. Pat. No. 4,959,480, Shimazaki et al U.S. Pat. No. 4,968,594, Ishige et al U.S. Pat. No. 4,988,614, Bowne et al U.S. Pat. No. 4,992,361, Renner et al U.S. Pat. No. 5,002,864, Bums et al U.S. Pat. No. 5,021,325, Sato et al U.S. Pat. No. 5,066,575, Morigaki et al U.S. Pat. No. 5,068,171, Ohya et al U.S. Pat. No. 5,071,739, Chen et al U.S. Pat. No. 5,100,772, Harder et al U.S. Pat. No. 5,110, 942, Kimura et al U.S. Pat. No. 5,116,990, Yokoyama et al U.S. Pat. No. 5,118,812, Kunitz et al U.S. Pat. No. 5,134, 059, Mizukawa et al U.S. Pat. No. 5,155,016, Romanet et al U.S. Pat. No. 5,183,728, Tang et al U.S. Pat. No. 5,234,805, Sato et al U.S. Pat. No. 5,235,058, Krishnarnurthy et al U.S. Pat. No. 5,250,400, Ikenoue et al U.S. Pat. No. 5,254,446, Krishnamurthy et al U.S. Pat. No. 5,262,292, Matsuoka et al U.S. Pat. No. 5,300,407, Romanet et al U.S. Pat. No. 5,302,496, Daifuku et al U.S. Pat. No. 5,336,593, Singer et al U.S. Pat. No. 5,350,667, Tang U.S. Pat. No. 5,395,968, Helling et al U.S. Pat. No. 5,354,826, Tang et al U.S. Pat. No. 5,358,829, Ishidai et al U.S. Pat. No. 5,368,998, Krishnamurthy et al U.S. Pat. No. 5,378,587, Mizukawa et al U.S. Pat. No. 5,409,808, Signer et al U.S. Pat. No. 5,411,841, Wolff U.S. Pat. No. 5,418,123, Tang U.S. Pat. No. 5,424, 179, Numata et al EPO 0 257 854, Bowne et al EPO 0 284 240, Webb et al EPO 0 341 204, Miura et al EPO 347,235, Yukio et al EPO 365,252, Yamazaki et al EPO 0 422 595, Kei EPO 0 428 899, Tadahisa et al EPO 0 428 902, Hieechi et al EPO 0 459 331, Sakanoue et al EPO 0 467 327, Kida et al, EPO 0 476 949, Kei et al, EPO 0 487 081, Wolfe EPO 0 489 333, Coraluppi et al EPO 0 512 304, Hirabayashi et al EPO 0 515 128, Harabayashi et at EPO 0 534 703, Sato et al EPO 0 554 778, Tang et al EPO 0 558 145, Mizukawa et al EPO 0 571 959, Schofield et al EPO 0 583 832, Schofield et al EPO 0 583 834, Hirabayashi et al EPO 0 584 793, Tang et al EPO 0 602 748, Tang et al EPO 0 602 749, Lau et al EPO 0 605 918, Allway EPO 0 622 672, Allway EPO 0 622 673, Kita et al EPO 0 629 912, Kapp et al EPO 0 646 841, Kita et al EPO 0 656 561, Ishidai et al EPO 0 660 177, Tanaka et al EPO 0 686 872, Thomas et al WO 90/10253, Williamson et al WO 92/09010, Leyshon et al, WO 92/10788, Crawley et al WO 92/12464, Williamson WO 93/01523, Merkel et al WO 93/02392, Krishnamurthy et al WO 93/02393, Williamson WO 93/07534, UK Patent Application 2,244,053, Japanese Patent Application 03192-350, Renner German OLS 3,624,103, Wolff et al German OLS 3,912,265, and Werner et al German OLS 40 08 067; and Compounds useful for forming yellow colored dyes upon coupling with oxidized color developer include, for example, Weissberger U.S. Pat. No. 2,298,443, Okumura et al U.S. Pat. No. 4,022,620, Buckland et al U.S. Pat. No. 4,758,501, Ogawa et al U.S. Pat. No. 4,791,050, Buckland et al U.S. Pat. No. 4,824,771, Sato et al U.S. Pat. No. 4,824,773, Renner et al U.S. Pat. No. 4,855,222, Tsoi U.S. Pat. No. 4,978,605, Tsuruta et al U.S. Pat. No. 4,992,360, Tomotake et al U.S. Pat. No. 4,994,361, Leyshon et al U.S. Pat. No. 5,021,333, Masukawa U.S. Pat. No. 5,053,325, Kubota et al U.S. Pat. No. 5,066,574, Ichijima et al U.S. Pat. No. 5,066,576, Tomotake et al U.S. Pat. No. 5,100,773, Lau et al U.S. Pat. No. 5,118,599, Kunitz U.S. Pat. No. 5,143, 823, Kobayashi et al U.S. Pat. No. 5,187,055, Crawley U.S. Pat. No. 5,190,848, Motoki et al U.S. Pat. No. 5,213,958, Tomotake et al U.S. Pat. No. 5,215,877, Tsoi U.S. Pat. No. 5,215,878, Hayashi U.S. Pat. No. 5,217,857, Takada et al U.S. Pat. No. 5,219,716, Ichijima et al U.S. Pat. No. 5,238, 803, Kobayashi et al U.S. Pat. No. 5,283,166, Kobayashi et al U.S. Pat. No. 5,294,531, Mihayashi et al U.S. Pat. No. 5,306,609, Fukuzawa et al U.S. Pat. No. 5,328,818, Yamamoto et al U.S. Pat. No. 5,336,591, Saito et al U.S. Pat. No. 5,338,654, Tang et al U.S. Pat. No. 5,358,835, Tang et al. U.S. Pat. No. 5,358,838, Tang et al U.S. Pat. No. 5,360,713, Morigaki et al U.S. Pat. No. 5,362,617, Tosaka et al U.S. Pat.

No. 5,382,506, Ling et al U.S. Pat. No. 5,389,504, Tomotake et al U.S. Pat. No. 5,399,474, Shibata U.S. Pat. No. 5,405,737, Goddard et al U.S. Pat. No. 5,411,848, Tang et al U.S. Pat. No. 5,427,898, Himmelmann et al EPO 0 327 976, Clark et al EPO 0 296 793, Okusa et al EPO 0 365 282, Tsoi EPO 0 379 309, Kida et al EPO 0 415 375, Mader et al EPO 0 437 818, Kobayashi et al EPO 0 447 969, Chino et al EPO 0 542 463, Saito et al EPO 0 568 037, Tomotake et al EPO 0 568 196, Okumura et al EPO 0 568 777 and Yamada et al EPO 0 570 006, Kawai EPO 0 573 761, Carmack et al EPO 0 608 956, Carmack et al EPO 0 608 957, Mooberry et al EPO 0 628 865.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support).

The present invention also contemplates the use of photographic elements of the present invention in what are often referred to as single use cameras (or "film with lens" units). Single use cameras are well known and typically comprise (1) a plastic inner camera shell including a taking lens, a film metering mechanism, and a simple shutter and (2) a paper-cardboard outer sealed pack which contains the inner camera shell and has respective openings for the taking lens and for a shutter release button, a frame counter window, and a film advance thumbwheel on the camera shell. The camera may also have a flash unit to provide light when the picture is taken. The inner camera shell has front and rear viewfinder windows located at opposite ends of a see-through viewfinder tunnel, and the outer sealed pack has front and rear openings for the respective viewfinder windows. At the manufacturer, the inner camera shell is loaded with a film cartridge, and substantially the entire length of the unexposed filmstrip is factory prewound from the cartridge into a supply chamber of the camera shell. After the customer takes a picture, the thumbwheel is manually rotated to rewind the exposed frame into the cartridge. The rewinding movement of the filmstrip the equivalent of one frame rotates a metering sprocket to decrement a frame counter to its next lower numbered setting. When substantially the entire length of the filmstrip is exposed and rewound into the cartridge, the single-use camera is sent to a photofinisher who first removes the inner camera shell from the outer sealed pack and then removes the filmstrip from the camera shell. The filmstrip is processed, and the camera shell and the opened pack are thrown away.

In the following discussion of suitable materials for use in elements of this invention, reference will be made to *Research Disclosure I*, The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section M, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237, EP 096 570; U.S. Pat. No. 4,420,556, and U.S. Pat. No. 4,543,323. ) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578, 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342, 4,886,736; 4,937,179, 4,946,767; 4,948,716; 4,952,485; 4,956,269; 4,959,299; 4,966,835; 4,985,336 as well as in patent publications GB 1,560,240, GB 2,007,662, GB 2,032,914; GB 2,099,167; DE 2,842,063, DE 2,937,127; DE 3,636,824;

DE 3,644,416 as well as the following European Patent Publications: 272,573; 335,319; 336,411, 346,899; 362,870; 365,252; 365,346; 373,382; 376,212; 377,463; 378,236; 384,670; 396,486; 401,612, 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

The type of silver halide grains to be used in the practice of this invention may include polymorphic, cubic, and octahedral. The grain size of the silver halide may have any distribution known to be useful in photographic compositions, and may be either polydispersed or monodispersed.

Preferably, tabular grain silver halide emulsions may be used in the practice of this invention. Tabular grains are those with two parallel major faces each clearly larger than any remaining grain face and tabular grain emulsions are those in which the tabular grains account for at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8, or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements.

Tabular grains formed of silver halide(s) that form a face centered cubic (rock salt type) crystal lattice structure can have either {100} or {111} major faces. Emulsions containing {111 } major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide used in the photographic element of the present invention may be silver iodobromide, silver bromide, silver chloride, silver chlorobromide, silver chlorolodobromide, and the like.

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 36544, Section I. Emulsion grains and their preparation, sub-section G. Grain modifying conditions and adjustments, paragraphs (3), (4) and (5), can be present in the emulsions of the invention. Doping with selenium or with selenium and iridium as described in Johnson and Wightman U.S. Pat. No. 5,164,292 may be particularly beneficial. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Discolosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

Although generally preferred concentration ranges for the various SET and non-SET Ir dopants have been set out above, it is recognized that specific optimum concentration ranges within these general ranges can be identified for specific applications by routine testing. It is specifically contemplated to employ the SET and non-SET Ir dopants singly or in combination. For example, grains containing a combination of an SET dopant and a non-SET Ir dopant are specifically contemplated.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

A summary of useful spectral sensitizing dyes is contained in Research Disclosure 308119, Section V. Also of interest are sensitizing dyes disclosed in U.S. Pat. Nos. 4,439,520, 4,581,329; 4,582,786; 4,592,621; 4,609,621, 4,675,279; 4,678,741; 4,720,451; 4,818,675; 4,945,036; and 4,952,491, the entire disclosures thereof are incorporated herein by reference.

Preferred red sensitizing dyes include, for example:

Anhydro-5,5'-dichloro-9-ethyl-3,3'-di-(3-sulfopropyl) thiacarbocyanine hydroxide, triethylammonium salt, Anhydro-9-ethyl-5',6'-dimethoxy-5-phenyl-3-(3-sulfobutyl)-3'-(3-sulfopropyl)oxatbiacarbocyanine hydroxide;

Anhydro-9-ethyl-5,5'-dimethyl-3,3'-di-(3-sulfopropyl) thiacarbocyanine hydroxide, triethylammonium salt;

Anhydro-9-ethyl-5',6'-dimethyl-5-phenyl-3-(2-sulfoethyl)-3'-(4-sulfobutyl)oxathiacarbocyanine hydroxide, sodium salt;

Anhydro-11-ethyl-1,1'-di-(3-sulfopropyl)naphtho[1,2-d] thiazolocarbocyanine hydroxide, triethylammonium salt;

Anhydro-5,5-dichloro-3,9-diethyl-3'-(3-sulfopropyl) thiacarbocyanine hydroxide,

Anhydro-5,6-dichloro-1-ethyl-1',3-di-(3-sulfopropyl) benzimidazolonaphtho[1,2-d]thiazolocarbocyanine hydroxide, triethylammonium salt;

3,3'-Di-(2-carboxyethyl)-5,5'-dichloro-9-ethylthiacarbocyanine bromide;

Anhydro-9-ethyl-3-methyl-S-phenyl-3'-(3-sulfopropyl) oxaselenacarbocyanine hydroxide;

2,4,6(1H,3H,5H)-Pyrimidinetrione, 5-(2-(1-ethylnaphtho[1,2-d]thiazol-2(3H)-ylidene)-1-((1-ethylnaphtho[1,2-d]thiazol-2(3H)-ylidene)methyl)ethylidene)-1,3-bis-(2-methoxyethyl)-1,1',11-triethylnaphtho[1,2-d] thiazolocarbocyanine bromide;

Anhydro-3,9-diethyl-5,5'-dimethoxy-3-(3-sulfopropyl) thiacarbocyanine hydroxide, Anhydro-9-ethyl-5,6-dimethoxy-5'-phenyl-3,3'-di-(3-sulfopropyl)thiacarbocyanine hydroxide, potassium salt;

Anhydro-9-ethyl-5',6'-dimethoxy-5-phenyl-3,3'-di-(3-Sulfopropyl)oxathiacarbocyanine hydroxide, sodium salt;

2-(2-(4-diethylaminophenyl)ethenyl)benzothiazole

Anhydro-9-ethyl-5,6-dimethyl-3-(2-sulfoethyl)-3'-(3-sulfopropyl)naphtho[1,2-d]thiazolooxacarbocyanine hydroxide, tetramethyguanidinium salt;

Anhydro-5,5'-dichloro-9-ethyl-3,3'-di-(3-(2-hydroxysulfopropyl))thiacarbocyanine hydroxide, triethylammonium salt;

Anhydro-3-ethyl-9,11-neopentylene-3'-(3-sulfopropyl) thiadicarbocyanine hydroxide;

3,3'-diethyl-9,11-neopentylene-thiadicarbocyanine p-toluenesulfonate;

3,3'-di-(2-hydroxyethyl) thiadicarbocyanine bromide.

Preferred green sensitizing dyes are, for example:

Anhydro-5-chloro-9-ethyl-5'-phenyl-3'-(3-sulfobutyl)-3-(3-sulfopropyl)oxacarbocyanine hydroxide, triethylammonium salt;

Anhydro-6,6'-dichloro-1,1'-diethyl-3,3'-di-(3-sulfbpropyl)-5,5'bis(trifluoromethyl) benzimidazolocarbocyanine hydroxide, triethylammonium salt;

Anhydro-11-ethyl-1,1'-di-(3-sulfopropyl)naphth[1,2-d] oxazolocarbocyanine hydroxide, triethylammonium salt;

Anhydro-5-chloro-9-ethyl-5'-phenyl-3'-(2-sulfoethyl)-3-(3-sulfopropyl)oxacarbocyanine hydroxide, triethylammonium salt;

Anhydro-6,6'-dichloro-1,1'-diethyl-3,3'-di-(4-sulfobutyl)-5,5'-bis(trifluoromethyl)benzimidazolocarbocyanine hydroxide, triethylammonium salt;

Anhydro-9-ethyl-5,5'-diphenyl-3,3'-di-(2-sulfoethyl) oxacarbocyanine hydroxide, sodium salt;

Anhydro-9-ethyl-5-t-pentyl-5'-phenyl-3-(4-sulfobutyl)-3'-(2-sulfoethyl) oxacarbocyanine hydroxide, triethylammonium salt;

Anhydro-9-ethyl-5,5'-diphenyl-3,3'-di-(4-sulfobutyl) oxacarbocyanine hydroxide, sodium salt;

5,5-Dicyano-1,1',3-triethyl-3'-(4-acetylsulfamoylbutyl) benzimidazolocarbocyanine bromide;

Anhydro-9-ethyl-5,5'-diphenyl-3,3'-di-(3-sulfobutyl) oxacarbocyanine hydroxide, sodium salt;

Anhydro-9-ethyl-5,5'-dichloro-3,3'-di-(3-sulfopropyl) oxacarbocyanine hydroxide, triethylammonium salt;

Anhydro-5,5',6,6'-tetrachloro-1,1',3-triethyl-3-(3-sulfopropyl)benzimidazolocarbocyanine hydroxide;

Anhydro-3,9-diethyl-5-phenyl-3'-(3-sulfopropyl) oxacarbocyanine hydroxide,

Anhydro-9-ethyl-5,5'-diphenyl-3,3'-di-(3-sulfopropyl) oxacarbocyanine hydroxide, sodium salt;

Anhydro-5-chloro-9-ethyl-5'-phenyl-3,3-di-(3-sulfopropyl) oxacarbocyanine hydroxide, triethylammonium salt;

Anhydro-9-ethyl-5,5'-diphenylcarbamoyl-3,3'-di-(3-sulfopropyl)oxacarbocyanine hydroxide, triethylammonium salt;

Anhydro-9-ethyl-3'-ethyl-3-[(N-methylsulfonyl) carbamoylmethyl]-5'-phenyloxathiacarbocyanine hydroxide;

Anhydro-9-ethyl-3'-ethyl-3-[(N-methylsulfonyl) carbamoylmethyl]-5'-phenyl-(3'-sulfopropyl) oxathiacarbocyanine hydroxide, triethylammonium salt.

Preferred blue sensitizing dyes include, for example:

Anhydro-5,5'-dichloro-3,3'-di-(3-sulfopropyl)thiacyanine hydroxide, triethylammonium. salt;

Anhydro-5,5'-dichloro-3,3'-di-(4-sulfobutyl)thiacyanine hydroxide, triethylammonium salt;

Anhydro-5,5'-dimethoxy-3,3'-di-(4-sulfobutyl) thiacyanine hydroxide, triethylammonium salt;

Anhydro-5-chloro-3,3'-di-(3-sulfopropyl)naphtho[1,2-d] thiazolothiacyanine hydroxide, triethylammonium salt, Anhydro-5-chloro-5'-phenyl-3,3'-di-(3-sulfopropyl) oxathiacyanine hydroxide, triethylammonium salt;

Anhydro-5-chloro-5'-(pyrrole-1-yl)-3,3'-di-(3-sulfopropyl)thiacyanine hydroxide, triethylammonium salt. Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, The Theory of the Photographic Process, 4th Edition, Macmillan, N.Y., 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The photographic elements of this invention may be processed utilizing either conventional processing systems, described above or low volume processing systems.

Low volume systems are those where film processing is initiated by contact to a processing solution, but where the processing solution volume is comparable to the total volume of the imaging layer to be processed. This type of system may include the addition of non-solution processing aids, such as the application of heat or of a laminate layer that is applied at the time of processing. Conventional photographic systems are those where film elements are processed by contact with conventional photographic processing solutions, and the volume of such solutions is very large in comparison to the volume of the imaging layer.

Low volume processing is defined as processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume system photographic element may receive some or all of the following treatments:

(I) Application of a solution directly to the film by any means, including spray, inkjet, coating, gravure process and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a imagewise manner to the auxiliary processing element.

(IV) Heating of the element by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Photographic elements and methods of processing such elements particularly suitable for use with this invention are described in *Research Disclosure*, February 1995, Item 37038, incorporated herein by reference.

The processed photographic elements of this invention may serve as origination material for some or all of the following processes: image scanning to produce an electronic rendition of the capture image, and subsequent digital processing of that rendition to manipulate, store, transmit, output, or display electronically that image. A number of modifications of color negative elements have been suggested for accommodating scanning, as illustrated by *Research Disclosure*, I Section XIV. Scan facilitating features *Research Disclosure*, and *Research Disclosure* September 1994, Item 36544. These systems are contemplated for use in the practice of this invention. Further examples of such processes and useful film features are also described in U.S. Pat. No. 5,840,470, U.S. Pat. No. 6,045,938; U.S. Pat. No. 6,021,277; EP 961,482 and EP905,651.

For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor, which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with calorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily. The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, Cosgrove et al U.S. Pat. No. 5,644,647, and Reem and Sutton U.S. Pat. No. 5,667,944.

Illustrative systems of scan signal manipulation, including techniques for maximizing the quality of image records, are disclosed by Bayer U.S. Pat. No. 4,553,156; Urabe et al U.S. Pat. No. 4,591,923, Sasaki et al U.S. Pat. No. 4,631,578; Alkofer U.S. Pat. No. 4,654,722; Yamada et al U.S. Pat. No. 4,670,793, Klees U.S. Pat. Nos. 4,694,342 and 4,962,542; Powell U.S. Pat. No. 4,805,031; Mayne et al U.S. Pat. No. 4,829,370; Abdulwabab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569, Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645. Color image reproduction of scenes with color enhancement and preferential tone-scale mapping are described by Burh et al. in U.S. Pat. Nos. 5,300,381 and 5,528,339.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. The signal transformation techniques of Giorgianni et al '030 described in connection with FIG. 8 represent a specifically preferred technique for obtaining a color balanced image for viewing.

Further illustrations of the capability of those skilled in the art to manage color digital image information are provided by Giorgianni and Madden *Digital Color Management*, Addison-Wesley, 1998.

The following examples illustrate the preparation and evaluation of photographic elements of the invention.

EXAMPLES

Example 1

Emulsion E-1

An AgBrI tabular silver halide emulsion (Emulsion E-1) was prepared containing 4.5% total iodide distributed such that the central portion of the emulsion grains contained no iodide and the perimeter area contained substantially higher iodide as described by Chang et. al., U.S. Pat. No. 5,314,793. The emulsion grains had an average thickness of 0.13 $\mu$m and average circular diameter of 1.2 $\mu$m. The emulsion was precipitated using oxidized gelatin and contained 0.2 mg KSeCN per silver mole introduced at 68% of the precipitation and 0.003 mg $K_2IrCl_6$ per Ag mole introduced at approximately 65%. The emulsion was optimally chemically and spectrally sensitized by adding Ig HB-3/mole silver; NaSCN, $8\times10^{-4}$ mole/mole Ag of the green sensitizing dye GSD-1, $2\times10^{-4}$ mole/mole Ag of the green sensitizing dye GSD-2, $Na_3Au(S_2O_3)_2.2H_2O$, $Na_2S_2O_3.5H_2O$ and a benzothiazolium finish modifier. The emulsion was then subjected to a heat cycle to 60° C. The antifoggant-stabilizer, tetraazaindene, at a concentration of $1.02\times10^{-2}$ mole/mole silver, was added to the emulsion melt after the chemical sensitization procedure.

Multilayer (ML) film examples demonstrating the principles of this invention were produced by coating on cellulose triacetate (coverages are in grams per meter squared unless otherwise stated, emulsion sizes are reported in Diameter×Thickness in microns). Layers are numbered beginning with the layer closest to the support. Structures for compounds are given at the end of the example section. Variations of emulsion E-1 containing various FED compounds were coated in layer 6, the experimental layer.

ML-Sample A1:

Layer 1 (Antihalation layer): black colloidal silver sol at 0.172; OxDS-1 at 0.135, ADD-1 at 0.001; ADD-2 at 0.001, and gelatin at 2.05.

Layer 2 (Slow cyan layer): a blend of two red sensitized (both with a mixture of RSD-1 and RSD-2) tabular silver iodobromide emulsions: (i) 1.0×0.09 microns, 4.1 mole % I at 0.323 (ii) 0.55×0.08 micron, 1.5 mole % I at 0.431, cyan dye-forming coupler CC-1 at 0.535; bleach accelerator releasing coupler B-1 at 0.031, masking coupler CM-1 at 0.03; ADD-6 at 1.8 g/mol silver and gelatin at 2.024

Layer 3 (Mid cyan layer): a red sensitized (as above) tabular silver iodobromide emulsion: (i) 1.25×0.12 micron, 4.1 mole % I at 0.883, cyan coupler CC-I at 0.105; IR-7 at 0.093; CM-I at 0.018; ADD-6 at 1.8 g/mol silver and gelatin at 1.012

Layer 4 (Fast cyan layer): a red sensitized (same as above) tabular silver iodobromide emulsion (2.2×0.13 micron, 4.1 mole % I) at 1.076; CC-1 at 0.120; IR-7 at 0.019; CM-1 at 0.032; ADD-6 at 1.8 g/mol silver; ADD-7 at 0.05 mg/mol silver and gelatin at 1.270

Layer 5 (Interlayer): OxDS-1 at 0.075; ADD-9 at 0.002; and gelatin at 0.700.

Layer 6 (magenta layer): emulsion E-1 at 1.08; MC-1 at 0.54; IR-4 at 0.005; IR-3 at 0.032; HB3 at 4 g/mol silver, ADD-6 at 1.8 g/mol silver, and gelatin at 1.465.

Layer 7 (Yellow filter layer): yellow filter dye YFD-1 at 0.161, OxDS-1 at 0.075; ADD-9 at 0.002; HB3 at 0.269, and gelatin at 0.648.

Layer 8: (Slow yellow layer) a blend of three silver iodobromide emulsions blue sensitized with BSD-2: (i) 1.3×0.14 micron, 4.1 mole % iodide at 0. 184 (ii) 1.0×0.13 micron, 1.5 mole % iodide at 0.172 and (iii) 0.55×0.08 micron, 1.3 mole % iodide at 0.172; yellow dye forming coupler YC-1 at 0.81; IR-1 at 0.022, B-1 at 0.007, ADD-6 at 1.8 g/mol silver; ADD-1 at 0.14 g/mole silver; ADD-7 at 0.1 mg/mole silver, and gelatin at 1.505.

Layer 9: (Fast yellow layer) a 2.9×0.14 micron silver iodobromide emulsions blue sensitized with BSD-2:; yellow dye forming coupler YC-1 at 0.45, IR-1 at 0.11, B-1 at 0.007; ADD-6 at 1.8 g/mol silver and gelatin at 1.188.

Layer 10 (UV filter layer and Protective Overcoat): silver bromide Lippman emulsion at 0.216; UV-2 at a total of 0.108, gelatin at 1.08, ADD-8 at 0.001, matte beads, and 1,1'-(methylene bis(sulfonyl))bis-ethene hardener at 1.5% of total gelatin weight.

Surfactants, coating aids, emulsion addenda, sequestrants, thickeners, lubricants, matte and tinting dyes were added to the appropriate layers as is common in the art. ML-A2 through A9 are like ML-A1 except FED compounds were added to layer 6 prior to coating as described in Table I.

Samples of each ML element were given a stepped exposure for 0.01 seconds to a light source with an effective color temperature of 5500 K and processed in the KODAK FLEXICOLOR (C-41) process as described in *British Journal of Photography Annual*, 1988, pp 196–198. Green speed was measured in relative log units as (1-logH) where H is the exposure in lux-sec necessary to produce a magenta density 0.5 above Dmin. Relative speed was set equal to 1.00 for the multilayer element containing no FED compound.

Latent image keeping was measured by aging samples of each element for 3 weeks at 100° F. and 50% relative humidity (RH), then exposing the samples as described above, and then aging the samples for a further 1 week at 100° F. and 50% RH before processing the samples as described above. Latent image keeping speed changes were determined by comparing the green speed obtained for these samples to the green speed obtained for samples that were aged for 4 weeks at 100° F. and 50% RH before exposing and processing. Changes in magenta Dmin with keeping were obtained by comparing the Dmin obtained for samples that were aged for 4 weeks at 100° F. and 50% RH before exposing and processing to the Dmin obtained for samples that were held for 4 weeks at 0° F. and 50% RH before exposing and processing.

TABLE I

Fresh speed and keeping behavior for green sensitive layer of ML with FED compounds added

| ML | FED cmpd in layer 6 | Amount of FED (mg/mole Ag) | Fresh speed | Fresh Dmin | Change in speed with LIK | Change in Dmin with keeping |
|---|---|---|---|---|---|---|
| A1 | None | None | 1.00 | 0.62 | −0.11 | 0.00 |
| A2 | FED-23 | 0.25 | 1.02 | 0.62 | −0.04 | 0.02 |
| A3 | " | 0.50 | 1.03 | 0.63 | −0.01 | 0.04 |
| A4 | " | 1.00 | 1.06 | 0.65 | +0.06 | 0.20 |
| A5 | FED-24 | 11.0 | 1.01 | 0.64 | +0.02 | 0.06 |
| A6 | " | 22.0 | 1.02 | 0.65 | +0.04 | 0.11 |
| A7 | FED-15 | 0.25 | 1.01 | 0.63 | −0.04 | 0.01 |
| A8 | " | 0.50 | 1.03 | 0.63 | −0.02 | 0.03 |
| A9 | " | 1.00 | 1.05 | 0.65 | +0.05 | 0.14 |

The data in Table I show that a significant speed loss was observed after latent image keeping for the green sensitized emulsion of this multilayer element when no FED compound added (ML A1). Addition of low levels of FED decreased this speed loss (ML's A2 and A7) and could essentially eliminate it (ML's A3, A5, and A8). These levels of FED gave only small increases in fresh speed and the improvement in latent image keeping occurred with only a small increase in Dmin of the coating with keeping. However, if enough FED was added to give a larger speed gain, the speed change with latent image keeping became positive, which is also undesirable (ML's A4, A6, and A9). Further, at these higher FED levels the change in Dmin with keeping became significant. Consequently, it is important to adjust the level of the FED compound to an amount where the speed gain is less than 0.05 log units in order to achieve optimum LIK performance in the green sensitive layer of this multicolor element.

Example 2

Emulsion E-2

An AgBrI tabular silver halide emulsion (Emulsion E-2) was prepared containing 4.1% total iodide distributed such that the central portion of the emulsion grains contained 1.1% iodide and the perimeter area contained substantially higher iodide as described by Chang et. al., U.S. Pat. No.

5,314,793. The emulsion grains had an average thickness of 1.0 $\mu$m and average circular diameter of 0.09 $\mu$m. The emulsion was precipitated using deionized gelatin and contained 0.2 mg KSeCN per silver mole introduced at 80% of the precipitation and 0.1 mg $K_2IrCl_6$ per Ag mole introduced at approximately 80%. The emulsion was optimally chemically and spectrally sensitized by adding NaSCN, $9.7\times10^{-4}$ moles red sensitizing dye RSD-1 and $1.1\times10^{-4}$ moles of RSD-4; $Na_3Au(S_2O_3)_2.2H_2O$, $Na_2S_2O_3.5H_2O$ and a benzothiazolium finish modifier. The emulsion was then subjected to a heat cycle to 65° C. The antifoggant-stabilizer, tetraazaindene, at a concentration of $1.02\times10^{-2}$ mole/mole silver, was added to the emulsion melt after the chemical sensitization procedure.

Multilayer (ML) film examples demonstrating the principles of this invention were produced by coating on cellulose triacetate (coverages are in grams per meter squared unless otherwise stated, emulsion sizes are reported in Diameter×Thickness in microns). Layers are numbered beginning with the layer closest to the support. Structures for compounds are given at the end of the example section. Variations of emulsion E-2 containing various FED compounds were coated in layer 2, the experimental layer.

ML-B1 like ML-A1 except

Layer 1=like ML-A1 but with HB3 added at 0.270.

Layer 2=Cyan layer with Emulsion E2 at 1.08; cyan coupler CC-1 at 0.7; IR-7 at 0.033; B-1 at 0.065; HB3 at 0.004 g/mol silver; ADD-6 at 1.8 g/mol silver and gelatin at 1.012

Layer 3 =like ML-A1 layer 5

Layer 4 (Slow magenta layer): a blend of three green sensitized (all with a mixture of GSD-1 and GSD-2) silver iodobromide emulsions: (i) 0.8×0.11 micron, 4.1 mole % iodide at 0.237 and (ii) 0.8×0.12 micron, 3 mole % iodide at 0.043 and (iii) 0.55×0.08, 1.5 mole % iodide at 0.454; magenta dye forming coupler MC-1 at 0.334; MM-1 at 0.108; ADD-6 at 1.8 g/mol silver; OxDS-2 at 0.022; IR-8 at 0.011 and gelatin at 1.209.

Layer 5 (Mid magenta layer): a green sensitized (same as above) tabular silver iodobromide emulsion 2.8×0.11 micron, 4.1 mole % I at 1.00; MC-1 at 0.243; MM-1 at 0.01 1, IR-3 at 0.027; IR-8 at 0.016 OxDS-2 at 0.028; ADD-6 at 1.8 g/mol silver, and gelatin at 1.242.

Layer 6 (Fast magenta layer): a green sensitized tabular silver iodobromide (2.8×0.13 micron, 4.1 mole % I) emulsion at 1.044; MC-1 at 0.033; MM-1 at 0.022; IR-4 at 0.011; OxDS-2 at 0.022; A-1 at 0.022, ADD-6 at 1.8 g/mol silver, and gelatin at 1.223

Layer 7 (Yellow filter layer): yellow filter dye YFD-1 at 0.108; OxDS-1 at 0.075; ADD-9 at 0.002; and gelatin at 0.648.

Layer 8: (Slow yellow layer) a blend of three silver iodobromide emulsions blue sensitized with BSD-2: (i) 1.3×0.14 micron, 4.1 mole % iodide at 0.281; (ii) 1.0×0.13 micron, 1.5 mole % iodide at 0.443 and (iii) 0.55×0.08 micron, 1.3 mole % iodide at 0.281, yellow dye forming coupler YC-1 at 0.86; IR-1 at 0.043, CC-1 at 0.086 g/m$^2$, B-1 at 0.007, ADD-2 at 7 mg/mole silver, ADD-7 at 0.24 mg/ mole silver; ADD-6 at I .8 g/mol silver and gelatin at 1.24.

Layer 9: (Fast yellow layer) a 2.9×0.14 micron silver iodobromide emulsions blue sensitized with BSD-2; yellow dye forming coupler YC-1 at 0.28; IR-1 at 0.103, B-1 at 0.007; ADD-6 at 1.8 g/mol silver and gelatin at 1.188.

Layer 10 (UV filter layer): silver bromide Lippman emulsion at 0.216, UV-2 and UV-2 at a total of 0.108 each; gelatin at 1.242, ADD-8 at 0.001, and 1,1'-(methylene bis(sulfonyl))bis-ethene hardener at 1.6% of total gelatin weight.

Layer 11 (Protective Overcoat) Matte beads; gelatin at 0.888

Surfactants, coating aids, emulsion addenda, sequestrants, thickeners, lubricants, matte and tinting dyes were added to the appropriate layers as is common in the art.

ML-B2 through B7 are like ML-B1 except FED compounds were added to layer 2 prior to coating as described in Table II.

Samples of each element were exposed and processed as described for Example 1. Red speed was measured in relative log units as (1-logH) where H is the exposure in lux-sec necessary to produce a cyan density 0.5 above Dmin. Relative speed was set equal to 1.00 for the multilayer element containing no FED compound. Latent image keeping changes and Dmin changes with keeping were measured as described for Example 1, except that speed and Dmin changes were measured for the cyan layer.

TABLE II

Fresh speed and keeping behavior for red sensitive layer of ML with FED compounds added

| ML | FED cmpd | Amount of FED (mg/mole Ag) | Fresh speed | Fresh Dmin | Change in speed with LIK | Change in Dmin with keeping |
|---|---|---|---|---|---|---|
| B1 | None | None | 1.00 | 0.17 | −0.03 | 0.01 |
| B2 | FED-23 | 0.15 | 0.99 | 0.19 | −0.01 | 0.01 |
| B3 | | 0.30 | 0.98 | 0.21 | +0.00 | 0.01 |
| B4 | FED-24 | 4.0 | 0.99 | 0.19 | −0.03 | 0.01 |
| B5 | | 8.0 | 0.99 | 0.19 | +0.00 | 0.02 |
| B6 | FED-15 | 0.20 | 0.99 | 0.18 | −0.02 | 0.01 |
| B7 | | 0.40 | 1.00 | 0.19 | −0.01 | 0.01 |

The data in Table II show that a small speed loss was observed after latent image keeping for the red sensitized emulsion of this multilayer element when no FED compound added (ML B1). Addition of low levels of FED decreased this speed loss (ML's B2, B6 and B7) and could eliminate it (ML's B3 and B5). For this red sensitized emulsion, these levels of FED gave no increases in fresh speed and very slight increases in cyan Dmin . Thus, the amount of FED needed to improve latent image keeping was much less than would be required to produce a significant speed gain. These levels of FED also produced essentially no increase in Dmin with keeping.

Example 3

Emulsion E-3

An AgBrI tabular silver halide emulsion (Emulsion E-2) was prepared containing 4.5% total iodide distributed such that the central portion of the emulsion grains contained no iodide and the perimeter area contained substantially higher iodide as described by Chang et. al., U.S. Pat. No. 5,314,793. The emulsion grains had an average thickness of 0.13 $\mu$m and average circular diameter of 1.2 $\mu$m. The emulsion was precipitated using oxidized gelatin and contained 0.2 mg KSeCN per silver mole introduced at approximately 70% of the precipitation and 0.003 mg $K_2IrCl_6$ per Ag mole introduced at approximately 65%. The emulsion was optimally chemically and spectrally sensitized by adding the antifoggant HB3, NaSCN, $8.0\times10^{-4}$ mole/mole Ag of the green sensitizing dye GSD-1, $2.0\times10^{-4}$ mole/mole Ag of the green sensitizing dye GSD-2, $Na_3Au(S_2O_3)_2.2H_2O$, $Na_2S_2O_3.5H_2O$ and a benzothiazolium finish modifier. The emulsion was then subjected to a heat cycle to 61° C. The antifoggant-stabilizer, tetraazaindene, at a concentration of $2.9\times10^{-3}$ mole/mole silver, was added to the emulsion melt after the chemical sensitization procedure.

Emulsion E-4

An AgBrI tabular silver halide emulsion (Emulsion E-4) was prepared containing 4.5% total iodide distributed such that the central portion of the emulsion grains contained no iodide and the perimeter area contained substantially higher iodide as described by Chang et. al., U.S. Pat. No. 5,314,793. The emulsion grains had an average thickness of 0.11 μm and average circular diameter of 0.6 μm. The emulsion was precipitated using oxidized gelatin and contained 0.2 mg KSeCN per silver mole introduced at approximately 70% of the precipitation and 0.003 mg $K_2IrCl_6$ per Ag mole introduced at approximately 65%. The emulsion was optimally chemically and spectrally sensitized by adding the antifoggant HB3, NaSCN, $9.9\times10^{-4}$ mole/mole Ag of the green sensitizing dye GSD-1, $2.5\times10^{-4}$ mole/mole Ag of the green sensitizing dye GSD-2, $Na_3Au(S_2O_3)_2.2H_2O$, $Na_2S_2O_3.5H_2O$ and a benzothiazolium finish modifier. The emulsion was then subjected to a heat cycle to 60° C. The antifoggant-stabilizer, tetraazaindene, at a concentration of $2.9\times10^{-3}$ mole/mole silver, was added to the emulsion melt after the chemical sensitization procedure.

Emulsion E-5

An AgBrI tabular silver halide emulsion (Emulsion E-5) was prepared containing 4.5% total iodide distributed such that the central portion of the emulsion grains contained no iodide and the perimeter area contained substantially higher iodide as described by Chang et. al., U.S. Pat. No. 5,314,793. The emulsion grains had an average thickness of 0.10 μm and average circular diameter of 0.5 μm. The emulsion was precipitated using oxidized gelatin and contained 0.2 mg KSeCN per silver mole introduced at approximately 70% of the precipitation and 0.025 mg $K_2IrCl_6$ per Ag mole introduced at approximately 65%. The emulsion was optimally chemically and spectrally sensitized by adding NaSCN, $7.2\times10^{-4}$ mole/mole Ag of the green sensitizing dye GSD-1, $1.8\times10^{-4}$ mole/mole Ag of the green sensitizing dye GSD-2, $Na_3Au(S_2O_3)_2.2H_2O$, $Na_2S_2O_3.5H_2O$ and a benzothiazolium finish modifier. The emulsion was then subjected to a heat cycle to 60° C. The antifoggant-stabilizer, tetraazaindene, at a concentration of $5.8\times10^{-3}$ mole/mole silver, was added to the emulsion melt after the chemical sensitization procedure.

Emulsion E-6

A cubic AgBrI emulsion (Emulsion E-6) was prepared containing 3.5 percent total iodide distributed evenly throughout the emulsion grains. The cubic emulsion grains have an average equivalent spherical diameter of 0.28 microns. The emulsion was precipitated under double jet conditions at 40 degrees C in standard gelatin using a straight-chain thioether ripener for size control. The only dopant, 0.315 mg of $K_2IrCl_6$ per silver mole, was added during a hold after a one minute nucleation. After ultrafiltration, the emulsion was optimally spectrally and chemically sensitized using 0.72 mmoles of GSD-1 and 0.18 mmoles of GSD-2, standard sources for sulfur and gold and a benzothiazolium finish modifier. The emulsion was subjected to a heat cycle at 65 degrees C. The antifoggant stabilizer, tetraazaindene, at a concentration of 10 mmoles per mole of silver, was added to the emulsion melt after the chemical sensitization process.

ML Sample C-1

The multilayer film structure utilized for this example is shown below, with structures of components provided at the end of the example section. Component laydowns are in grams per meter squared unless otherwise stated, emulsion sizes are reported in Diameter×Thickness in microns. 1,1'-(methylene bis(sulfonyl))bis-ethene hardener was used at 1.6% of total gelatin weight. Antifoggants (including 4-hydroxy-6-methyl-1,3,3a,7-tetraazaindene), surfactants, coating aids, coupler solvents, emulsion addenda, sequesterants, lubricants, matte and tinting dyes were added to the appropriate layers as is common in the art. Layers are numbered beginning with the layer furthest from the support. Layers 6 and 8 were the experimental layers with variations of emulsion E-3 containing the FED compound FED-24 coated in layer 6 and variations of the emulsion mixture of E-4, E-5, and E-6 containing the FED compound FED-24 coated in layer 8. When the FED compound was present in the layer, the antifoggant HB3 at 4 g/mole Ag was also added to the layer.

Layer I (Protective Overcoat Layer): gelatin at 0.89.

Layer 2 (UV Filter Layer): silver bromide Lippman emulsion at 0.215, V-1 at 0.097, UV-2 at 0.107, ADD-08 at 0.0012, and gelatin at 0.699.

Layer 3 (Fast Yellow Layer): a blend of two blue sensitized (with a mixture of BSD-1 and BSD-2) tabular silver iodobromide emulsions: (i) 2.7×0.13 μm, 4.1 mole % iodide at 0.344, (ii) 1.3×0.14 μm, 4.1 mole % iodide at 0.194. Yellow dye-forming coupler YC-1 at 0.226, IR-1 at 0.086, bleach accelerator releasing coupler B-1 at 0.005 and gelatin at 0.915.

Layer 4 (Slow Yellow Layer): a blend of three blue sensitized (all with a mixture of BSD-1 and BSD-2) tabular silver iodobromide emulsions: (i) 1.3×0.14 μm, 4.1 mole % iodide at 0.291, (ii) 0.8×0.14 μm, 1.5 mole % iodide at 0.387, (iii) 0.5×0.08 μm, 1.5 mole % iodide at 0.183. Yellow dye-forming couplers YC-1 at 0.699 and YC-2 at 0.430, IR-1 at 0.247, IR-2 at 0.022, bleach accelerator releasing coupler B-1 at 0.005, and gelatin at 2.32.

Layer 5 (Interlayer): OxDS-1 at 0.075, A-1 at 0.043, and gelatin at 0.538.

Layer 6 (Fast Magenta Layer): Emulsion E-3 at 0.603, magenta dye-forming coupler MC-1 at 0.086, masking coupler MM-1 at 0.032, IR-3 at 0.036, IR-4 at 0.003 and gelatin at 0.943.

Layer 7 (Mid Magenta Layer): a blend of two green sensitized (with a mixture of GSD-1 and GSD-2) silver iodobromide tabular emulsions: (i) 0.8×0.12 μm, 4.5 mole % iodide at 0.71 and (ii) 0.6×0.11 μm, 4.5 mole % iodide at 0.151. Magenta dye-forming coupler MC-1 at 0.247, masking coupler MM-1 at 0.118, IR-3 at 0.027, IR-5 at 0.024, and gelatin at 1.45.

Layer 8 (Slow magenta layer): a blend of Emulsion E-4 at 0.172, E-5 at 0.215 and E-6 at 0.161. Magenta dye-forming coupler MC-1 at 0.366, masking coupler MM-1 at 0.108, IR-5 at 0.031 and gelatin at 1.52.

Layer 9 (Interlayer): YFD-1 at 0.043, A-1 at 0.043, OxDS-1 at 0.081 and gelatin at 0.538.

Layer 10 (Fast Cyan layer): a red-sensitized sensitized (with a mixture of RSD-1, RSD-2 and RSD-3) silver iodobromide tabular emulsion (1.4×0.13 μm, 3.7 mole % iodide) at 0.81, cyan dye-forming coupler CC-1 at 0.210, IR-6 at 0.043, IR-7 at 0.059, masking coupler CM-1 at 0.027, and gelatin at 1.62.

Layer 11 (Mid Cyan Layer): a blend of two red-sensitized (both with a mixture of RSD-1, RSD-2, and RSD-3) tabular silver iodobromide emulsions: (i) 1.2×0.11 μm, 4.1 mole % iodide) at 0.344 and (ii) 1.0×0.11 μm, 4.1 mole % iodide at 0.430. Cyan dye-forming coupler CC-1 at 0.366, yellow dye-forming coupler YC-1 at 0.108, IR-2 at 0.038, masking coupler CM-1 at 0.016, and gelatin at 1.13.

Layer 12 (Slow cyan layer): a blend of two red sensitized (both with a mixture of RSD-1, RSD-2, and RSD-3)

tabular silver iodobromide emulsions: (i) 0.7×0.12 μm, 4.1 mole % iodide at 0.45 and (ii) 0.5×0.08), 1.5 mole % iodide at 0.603. Cyan dye-forming coupler CC-1 at 0.583, masking coupler CM-1 at 0.011, IR-7 at 0.034, bleach accelerator releasing coupler B-1 at 0.086 and gelatin at 1.92.

Layer 13 (Interlayer):OxDS-1 at 0.075 and gelatin at 0.538.

Layer 14 (Antihalation layer): Black Colloidal Silver at 0.151, OxDS-1 at 0.081, HB3 at 0.270, ADD-1 at 0.001; ADD-3 at 0.007, and gelatin at 1.61.

Support: annealed poly(ethylene naphthalate) with an applied magnetic layer on the backside as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumei Kyoukai Koukai Gihou No. 94-6023, published Mar. 15, 1994, available from the Japanese Pat. No. Office ML-C2 through C5 are like ML-C1 except that the FED compound FED-24 was added to layers 6 and/or 8 prior to coating as described in Table III.

Samples of each element were exposed and processed as described for Example 1 except that the exposure time used was 0.01 sec. Green speed was measured in relative log units as (1-logH) where H is the exposure in lux-sec necessary to produce a magenta density 0.15 above Dmin. Relative speed was set equal to 1.00 for the multilayer element containing no FED compound.

Latent image keeping was measured by aging samples of each element for 10 weeks at 78° F. and 50% RH, then exposing the samples as described above, and then aging the samples for a further 2 weeks at 78° F. and 50% RH before processing the samples as described above. Latent image keeping density changes for the fast magenta (FM) layer were determined by comparing the magenta density obtained at Step 7 (approximately 0.4 density units above Dmin) for these samples to the magenta density obtained at Step 7 for samples that were aged for 12 weeks at 78° F. and 50% RH before exposing and processing. Latent image keeping density changes for the slow magenta (SM) layer were determined in the same manner except that the magenta density was measured at step 15 (approximately 1.3 density units above Dmin). Changes in Dmin with keeping were obtained by comparing the magenta Dmin obtained for samples that were aged for 4 weeks at 100° F. and 50% RH before exposing and processing to the Dmin obtained for samples that were held for 4 weeks at 0° F. and 50% RH before exposing and processing.

TABLE III

Fresh speed and keeping behavior for magenta record of ML with FED-24 added

| | Amount of FED (mg/mole Ag) | | Fresh | Fresh | Δ density with LIK | | Δ Dmin with |
|---|---|---|---|---|---|---|---|
| ML | in FM | in SM | speed | Dmin | in FM | in SM | keeping |
| C1 | None | None | 1.00 | 0.66 | −0.029 | −0.031 | 0.01 |
| C2 | 5 | 5 | 1.00 | 0.66 | +0.00 | −0.011 | 0.01 |
| C3 | 15 | 5 | 1.00 | 0.66 | +0.013 | −0.004 | 0.03 |
| C4 | 15 | 15 | 1.00 | 0.66 | +0.021 | 0.020 | 0.04 |
| C5 | 5 | 15 | 1.01 | 0.66 | −0.005 | 0.016 | 0.03 |

The data in Table III illustrate how FED-24 can be used to selectively control the density changes caused by latent image keeping, depending on the layer in which the FED compound is placed. When FED-24 was absent from the magenta layers (ML C1), density losses from latent image keeping were seen at densities corresponding to both the fast magenta layer and the slow magenta layer. When FED-24 was added at 5 mg/mole Ag to the fast magenta layer (ML C2 or C5), this density loss for the fast magenta was essentially eliminated. However, when FED-24 was added at 15 mg/mole Ag to this layer, density gains were obtained, which is also undesirable (ML C3 or C4). Similarly, when FED-24 was added at 5 mg/mole Ag to the slow magenta layer (ML C2 or C3), LIK density losses corresponding to the slow magenta layer were significantly reduced but with an addition of 15 mg/mole of FED-24 to this layer (ML C4 or C5), density gains were observed. As can be seen from ML C2, addition of 5 mg of FED-24 in both the fast and slow layers gave an effectively stable latent image keeping position for this magenta record. None of the levels of FED-24 added caused any significant speed gain and only the higher levels gave any increase in Dmin with keeping.

Example 4

Emulsion E-7

AgBrI tabular silver halide emulsion (Emulsion E-7) was prepared containing 3.7% total iodide distributed such that the central portion of the emulsion grains contained no iodide and the perimeter area contained substantially higher iodide as described by Chang et. al., U.S. Pat. No. 5,314,793. The emulsion grains had an average thickness of 0.13 μm and average circular diameter of 3.2 μm. The emulsion was precipitated using oxidized gelatin and contained 0.2 mg KSeCN per silver mole and 0.025 mg $K_4Ru(CN)_6$ per Ag mole introduced at approximately 70%. The emulsion was optimally chemically and spectrally sensitized by adding NaSCN, $2.2\times10^{-4}$ mole/mole Ag of the blue sensitizing dye BSD-3, $6.6\times10^{-4}$ mole/mole Ag of the blue sensitizing dye BSD-1, carboxymethyl-trimethyl-2-thiourea (U.S. Pat. No. 4,810,626), tripotassium bis(1-[3-(2-sulfobenzamido)-phenyl]-5-mercaptotetrazole) gold(I), pentahydrate (U.S. Pat. No. 5,945,270) and a benzothiazolium finish modifier. The emulsion was then subjected to a heat cycle to 131° F. The antifoggant-stabilizer, 2-methylthio-4-hydroxy-6-methyl-1,3,3a,7-tetraazaindene, at a concentration of 1.3 mmole/mole silver, was added to the emulsion melt after the chemical sensitization procedure.

Emulsion E-8

AgBrI tabular silver halide emulsion (Emulsion E-7) was prepared containing 4.5% total iodide distributed such that the central portion of the emulsion grains contained no iodide and the perimeter area contained substantially higher iodide as described by Chang et. al., U.S. Pat. No. 5,314,793. The emulsion grains had an average thickness of 0.13 μm and average circular diameter of 1.8 μm. The emulsion was precipitated using oxidized gelatin and contained 0.2 mg KSeCN per silver mole and 0.0055 mg $K_2IrCl_6$ per Ag mole introduced at approximately 70%. The emulsion was optimally chemically and spectrally sensitized by adding NaSCN, $1.4\times10^{-4}$ mole/mole Ag of the blue sensitizing dye BSD-3, $5.6\times10^{-4}$ mole/mole Ag of the blue sensitizing dye BSD-1, carboxymethyl-trimethyl-2-thiourea (U.S. Pat. No. 4,810,626), tripotassium bis(1-[3-(2-sulfobenzamido)-phenyl]-5-mercaptotetrazole) gold(I), pentahydrate (U.S. Pat. No. 5,945,270) and a benzothiazolium finish modifier. The emulsion was then subjected to a heat cycle to 140° F. The antifoggant-stabilizer, 2-methylthio-4-hydroxy-6-methyl-1,3,3a,7-tetraazaindene, at a concentration of 1.3 mmole/mole silver, was added to the emulsion melt after the chemical sensitization procedure.

Emulsion E-9

AgBrI tabular silver halide emulsion (Emulsion E-9) was prepared containing 4.5% total iodide distributed such that the central portion of the emulsion grains contained no iodide and the perimeter area contained substantially higher iodide as described by Chang et. al., U.S. Pat. No. 5,314,793. The emulsion grains had an average thickness of 0.11 μm and average circular diameter of 0.8 μm. The emulsion was precipitated using oxidized gelatin and contained 0.2 mg KSeCN per silver mole and 0.012 mg $K_2IrCl_6$ per Ag mole introduced at approximately 70%. The emulsion was optimally chemically and spectrally sensitized by adding NaSCN, $1.8\times10^{-4}$ mole/mole Ag of the blue sensitizing dye BSD-3, $7.2\times10^{-4}$ mole/mole Ag of the blue sensitizing dye BSD-1, carboxymethyl-trimethyl-2-thiourea (U.S. Pat. No. 4,810,626), tripotassium bis(1-[3-(2-sulfobenzamido)-phenyl]-5-mercaptotetrazole) gold(I), pentahydrate (U.S. Pat. No. 5,945,270) and a benzothiazolium finish modifier. The emulsion was then subjected to a heat cycle to 140° F. The antifoggant-stabilizer, 2-methylthio-4-hydroxy-6-methyl-1,3,3a,7-tetraazaindene, at a concentration of 1.3 mmole/mole silver, was added to the emulsion melt after the chemical sensitization procedure.

Emulsion E-10

AgBrI tabular silver halide emulsion (Emulsion E-10) was prepared containing 3% total iodide distributed such that the central portion of the emulsion grains contained no iodide and the perimeter area contained substantially higher iodide as described by Chang et. al., U.S. Pat. No. 5,314,793. The emulsion grains had an average thickness of 0.12 μm and average circular diameter of 0.5 μm. The emulsion was precipitated using oxidized gelatin and contained 0.2 mg KSeCN per silver mole and 0.05 mg $K_2IrCl_6$ per Ag mole introduced at approximately 70%. The emulsion was optimally chemically and spectrally sensitized by adding NaSCN, $1.9\times10^{-4}$ mole/mole Ag of the blue sensitizing dye BSD-3, $7.6\times10^{-4}$ mole/mole Ag of the blue sensitizing dye BSD-1, carboxymethyl-trimethyl-2-thiourea (U.S. Pat. No. 4,810,626), tripotassium bis(1-[3-(2-sulfobenzamido)-phenyl]-5-mercaptotetrazole) gold(I), pentahydrate (U.S. Pat. No. 5,945,270) and a benzothiazolium finish modifier. The emulsion was then subjected to a heat cycle to 140° F. The antifoggant-stabilizer, 2-methylthio-4-hydroxy-6-methyl-1,3,3a,7-tetraazaindene, at a concentration of 1.3 mmole/mole silver, was added to the emulsion melt after the chemical sensitization procedure.

Emulsion E-11

An AgBrI tabular silver halide emulsion (Emulsion E-11) was prepared containing 3.7% total iodide distributed such that the central portion of the emulsion grains contained no iodide and the perimeter area contained substantially higher iodide as described by Chang et. al., U.S. Pat. No. 5,314,793. The emulsion grains had an average thickness of 0.12 μm and average circular diameter of 1.2 μm. The emulsion was precipitated using oxidized gelatin and contained 0.2 mg KSeCN per silver mole introduced at approximately 70% of the precipitation and 0.003 mg $K_2IrCl_6$ per Ag mole introduced at approximately 70%. The emulsion was optimally chemically and spectrally sensitized by adding NaSCN, $7.7\times10^{-4}$ mole/mole Ag of the green sensitizing dye GSD-1, $2.3\times10^{-4}$ mole/mole Ag of the green sensitizing dye GSD-3, carboxymethyl-trimethyl-2-thiourea (U.S. Pat. No. 4,810,626), tripotassium bis(1-[3-(2-sulfobenzamido)-phenyl]-5-mercaptotetrazole) gold(I), pentahydrate (U.S. Pat. No. 5,945,270), and a benzothiazolium finish modifier. The emulsion was then subjected to a heat cycle to 61° C. The antifoggant-stabilizer, tetraazaindene, at a concentration of 1 g/mole silver, was added to the emulsion melt after the chemical sensitization procedure.

ML-D-1:

The multilayer film structure utilized for this example is shown below, with structures of components provided at the end of the example section. Component laydowns are in grams per meter squared unless otherwise stated, emulsion sizes are reported in Diameter×Thickness in microns. 1,1'-(methylene bis(sulfonyl))bis-ethene hardener was used at 1.6% of total gelatin weight. Antifoggants (including 4-hydroxy-6-methyl-1,3,3a,7-tetraazaindene), surfactants, coating aids, coupler solvents, emulsion addenda, sequesterants, lubricants, matte and tinting dyes were added to the appropriate layers as is common in the art. Layers are numbered beginning with the layer furthest from the support. Layers 3, 4, 6 and 8 were the experimental layers. Variations of an emulsion mixture of E-7 and E-8 containing FED-2 were coated in layer 3 and variations of an emulsion mixture of E-8, E-9, and E-10 containing FED-2 were coated in layer 4. Variations of emulsion E-5 containing the FED compound FED-24 were coated in layer 6 and variations of emulsion E-12 containing the FED compound FED-24 were coated in layer 8. When the FED compounds were present in layers 3 and 4, the antifoggant HB3 at 1.75 g/mole Ag was also added to the layer. When the FED compounds were present in layers 6 and 8, the antifoggant HB3 at 4 g/mole Ag was also added to the layer.

ML-D1 is like ML-C1 except as follows:

Layer 1 (Protective Overcoat Layer): no change

Layer 2 (UV Filter Layer): no change

Layer 3 (Fast Yellow Layer): a blend of Emulsions E-7 at 0.430 and E-8 at 0.108. Yellow dye-forming coupler YC-1 at 0.247, IR-1 at 0.086, B-1 at 0.005 and gelatin at 0.915.

Layer 4 (Slow Yellow Layer): a blend of Emulsions E-8 at 0.269, E-9 at 0.484, and E-10 at 0.194. Yellow dye-forming coupler YC-1 at 1.13, IR-1 at 0.172, IR-2 at 0.022, B-1 at 0.005, and gelatin at 2.41.

Layer 5 (Interlayer): OxDS-1 at 0.075, A-1 at 0.032, and gelatin at 0.538.

Layer 6 (Fast Magenta Layer): Emulsion E-11 at 0.484, magenta dye-forming coupler MC-1 at 0.075, masking coupler MM-1 at 0.032, IR-3 at 0.036, IR-4 at 0.003 and gelatin at 0.943.

Layer 7 (Mid Magenta Layer): a blend of two green sensitized (with a mixture of GSD-1 and GSD-2) silver iodobromide tabular emulsions: (i) 0.8×0.12 μm, 4.5 mole % iodide at 0.43 and (ii) 0.6×0.11 μm, 4.5 mole % iodide at 0.269. Magenta dye-forming coupler MC-1 at 0.226, masking coupler MM-1 at 0.086, IR-3 at 0.023, IR-5 at 0.018, and gelatin at 1.47.

Layer 8 (Slow magenta layer): Emulsion E-5 at 0.484, magenta dye-forming coupler MC-1 at 0.366, masking coupler MM-1 at 0.108, IR-5 at 0.031 and gelatin at 1.52.

Layer 9 (Interlayer): same

Layer 10 (Fast Cyan layer): a red-sensitized sensitized (with a mixture of RSD-1, RSD-2 and RSD-3) iodobromide tabular emulsion (1.4×0.13 μm, 3.7 mole % iodide) at 0.484, cyan dye-forming coupler CC-1 at 0.199, IR-6 at 0.043, IR-7 at 0.048, masking coupler CM-1 at 0.011, and gelatin at 1.62.

Layer 11 (Mid Cyan Layer): a red-sensitized (with a mixture of RSD-1, RSD-2, and RSD-3) tabular iodobromide emulsion (0.8×0.11 μm, 4.5 mole % iodide) at 0.699, cyan dye-forming coupler CC-1 at 0.323, yellow dye-forming coupler YC-1 at 0.108, IR-2 at 0.038, masking coupler CM-1 at 0.013, and gelatin at 1.15.

Layer 12 (Slow Cyan layer): a blend of three red sensitized (all with a mixture of RSD-1, RSD-2, and RSD-3) tabular silver iodobromide emulsions: (i) 0.8×0.11 μm, 4.5 mole % iodide at 0.118, (ii) 0.5×0.12 μm, 3 mole % iodide at 0.215, and (iii) 0.4×0.11 μm, 0.5 mole % iodide at 0.484. Cyan dye-forming coupler CC-1 at 0.583, masking coupler CM-1 at 0.041, IR-2 at 0.043, bleach accelerator releasing coupler B-1 at 0.086 and gelatin at 1.92.

Layer 13 (Interlayer): A-1 at 0.043, OxDS-1 at 0.075 and gelatin at 0.538.

Layer 14 (Antihalation layer): same

Support: same

ML-D2 through D4 are like ML-D1 except that the FED compound FED-24 was added to layers 6 and 8 prior to coating and in some cases the FED compound FED-2 was added to layers 3 and 4, as described in Table IV.

Samples of each element were exposed and processed as described for Example 1 except that the exposure time used was 0.01 sec. Green speed was measured in relative log units as (1-logH) where H is the exposure in lux-sec necessary to produce a magenta density 0.15 above Dmin while blue speed was measured in the same units where H is is the exposure in lux-sec necessary to produce a yellow density 0.15 above Dmin. Relative speed was set equal to 1.00 for the multilayer element containing no FED compound.

Latent image keeping was measured using the aging conditions and exposure sequence described in Example 1. Latent image keeping density changes for the FM layer were determined using the magenta density obtained at Step 7 (approximately 0.4 density units above Dmin) while latent image keeping density changes for the SM layer were determined using the magenta density was measured at step 15 (approximately 1.3 density units above Dmin). Latent image keeping density changes for the fast yellow (FY) layer were determined using the yellow density obtained at Step 7 (approximately 0.4 density units above Dmin) while latent image keeping density changes for the slow yellow (SY) layer were determined using the yellow density was measured at step 15 (approximately 1.3 density units above Dmin). Changes in Dmin with keeping were obtained by comparing the magenta or yellow Dmin obtained for samples that were aged for 4 weeks at 100° F. and 50% RH before exposing and processing to the magenta or yellow Dmin obtained for samples that were held for 4 weeks at 0° F. and 50% RH before exposing and processing.

TABLE IVA

Fresh speed and keeping behavior for magenta record of multilayers with FED-24 added to magenta layers and FED-2 added to yellow layers

| | Amount of FED (mg/mole Ag) | | Fresh | Fresh | Δ density with LIK | | Δ Dmin with |
|---|---|---|---|---|---|---|---|
| ML | in FM | in SM | speed | Dmin | in FM | in SM | keeping |
| D1 | None | None | 1.00 | 0.65 | −0.053 | −0.034 | 0.014 |
| D2 | 6 | 4 | 1.00 | 0.65 | −0.006 | −0.007 | 0.025 |

TABLE IVA-continued

Fresh speed and keeping behavior for magenta record of multilayers with FED-24 added to magenta layers and FED-2 added to yellow layers

| | Amount of FED (mg/mole Ag) | | Fresh | Fresh | Δ density with LIK | | Δ Dmin with |
|---|---|---|---|---|---|---|---|
| ML | in FM | in SM | speed | Dmin | in FM | in SM | keeping |
| D3 | 6 | 4 | 1.01 | 0.65 | −0.012 | −0.009 | 0.027 |
| D4 | 3 | 4 | 1.01 | 0.65 | −0.031 | −0.010 | 0.025 |

TABLE IVB

Fresh speed and keeping behavior for yellow record of multilayer with FED-24 added to magenta layers and FED-2 added to yellow layers

| | Amount of FED (mg/mole Ag) | | Fresh | Fresh | Δ density with LIK | | Δ Dmin with |
|---|---|---|---|---|---|---|---|
| ML | in FY | in SY | speed | Dmin | in FY | in SY | keeping |
| D1 | None | None | 1.00 | 0.91 | −0.037 | −0.056 | 0.008 |
| D2 | None | None | 0.98 | 0.91 | −0.042 | −0.061 | 0 |
| D3 | 0.04 | 0.06 | 1.04 | 0.91 | −0.012 | −0.026 | 0.006 |
| D4 | 0.04 | 0.06 | 1.04 | 0.91 | −0.020 | −0.029 | 0.008 |

The data in Table IV illustrate how FED-24 in the magenta layers and FED-2 in the yellow layers can be used to selectively control the density changes caused by latent image keeping, depending on the layer in which the FED compound is placed. When FED compounds were absent from all layers (ML D1), density losses from latent image keeping were seen at densities corresponding to the fast and slow magenta layers and to the fast and slow yellow layers. When FED-24 was added to the magenta layers only (6 mg/mole Ag in the FM and 4 mg/mole Ag in the SM), the density loss corresponding to these layers was essentially eliminated while the density losses in the yellow layers remained (ML D2). These improvements in the magenta latent image keeping were obtained with essentially no change in fresh green speed and only a slight increase in magenta Dmin with keeping. When use of FED-24 in the magenta layers was combined with use of FED-2 in the yellow layers (0.04 mg in the FY and 0.06 mg in the SY), density losses in both the yellow and the magenta records were minimized (ML D3) and the remaining density changes were much better matched between color records than in the absence of FED compounds in these records.

Chemical Structures for Compounds used in the Examples

UV-1

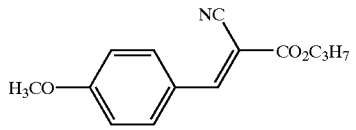

-continued
UV-2
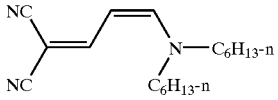
YC-1
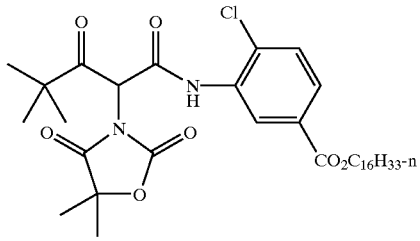
YC-2
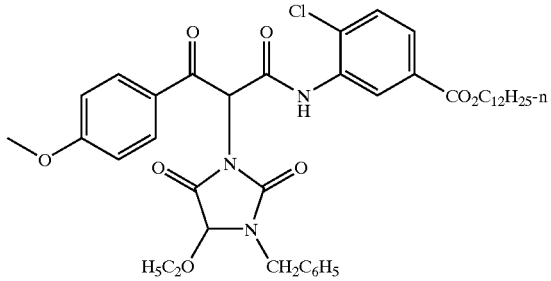
MC-1
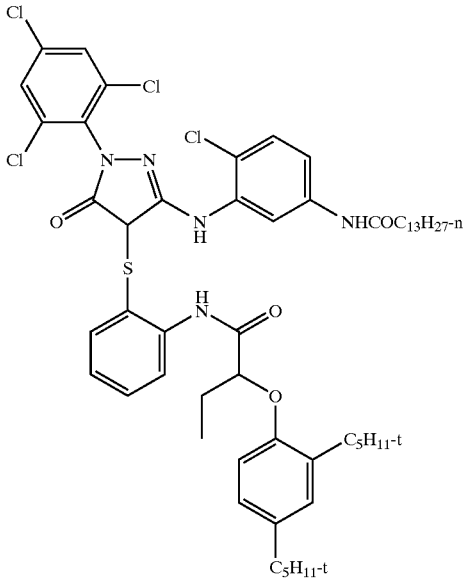
CC-1
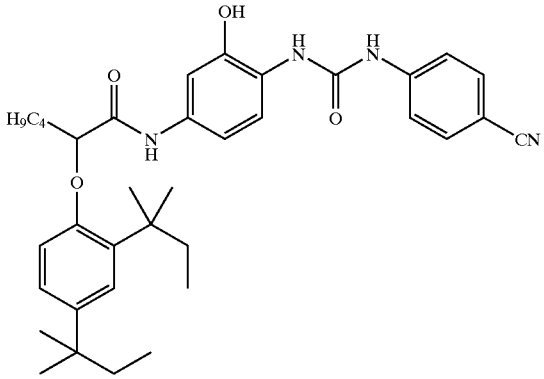

-continued
MM-1
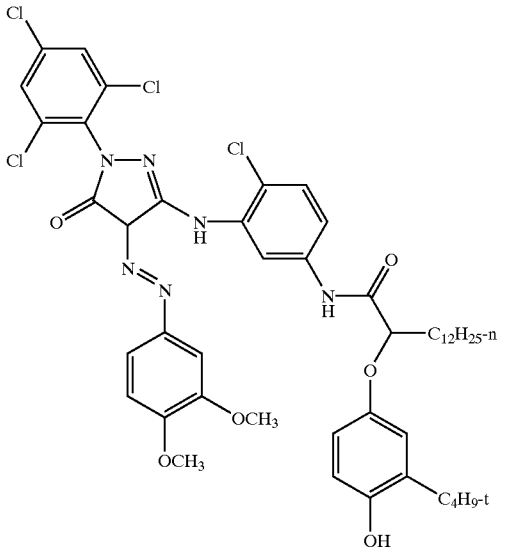
CM-1
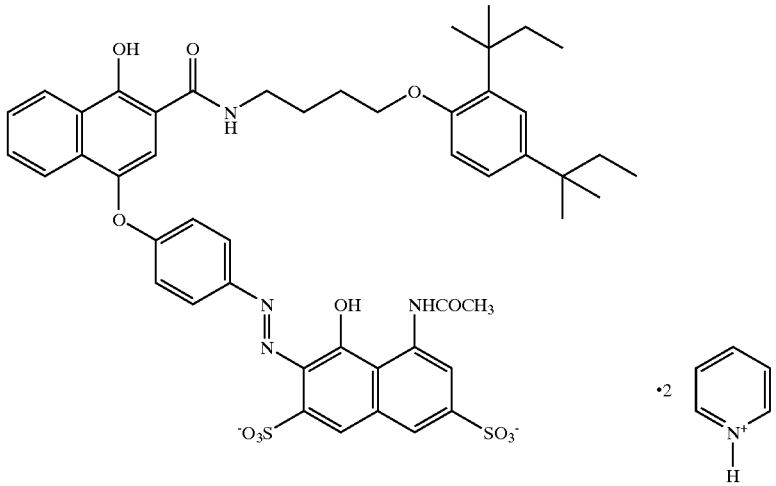
IR-1
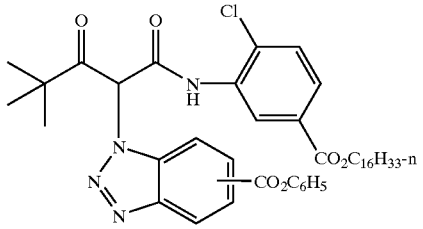
IR-2
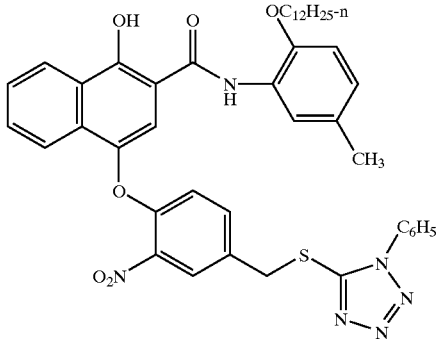

-continued
IR-3
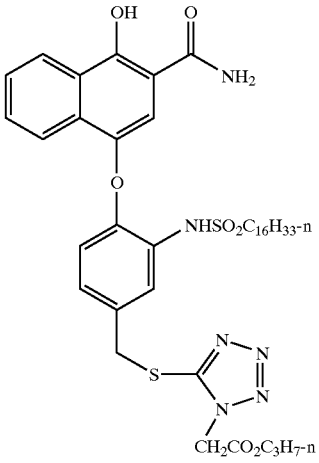
IR-4
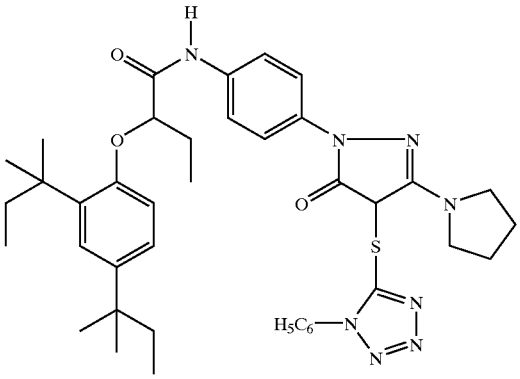
IR-5
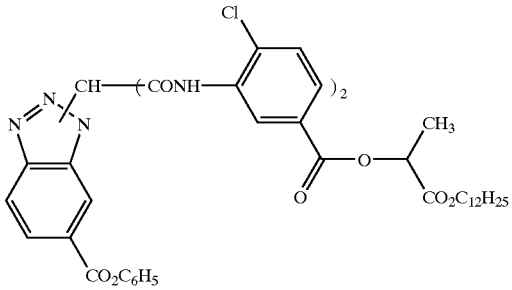
IR-6
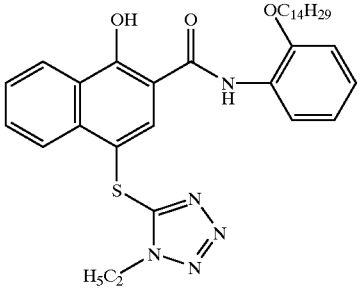

-continued
IR-7
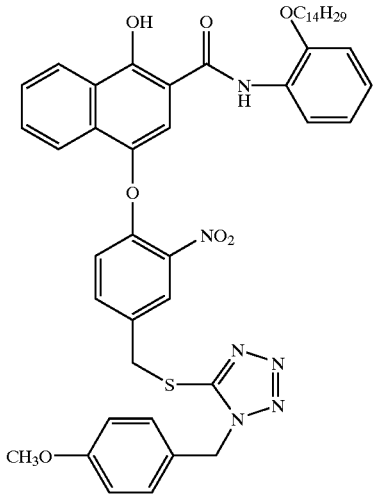
IR-8
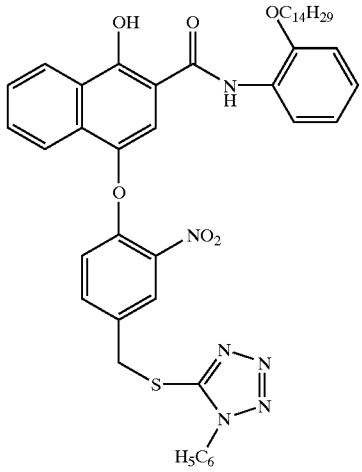
B-1
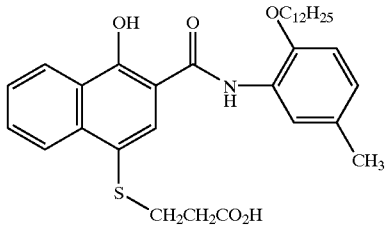
A-1
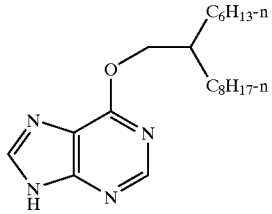

-continued
BSD-1
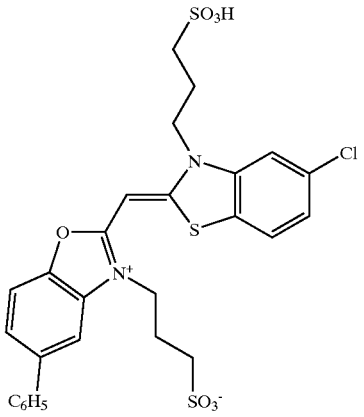
BSD-2
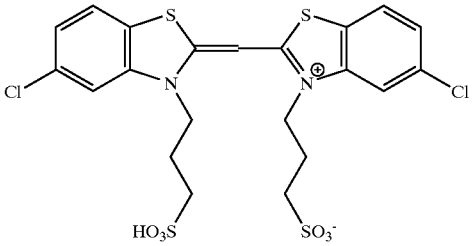
BSD-3
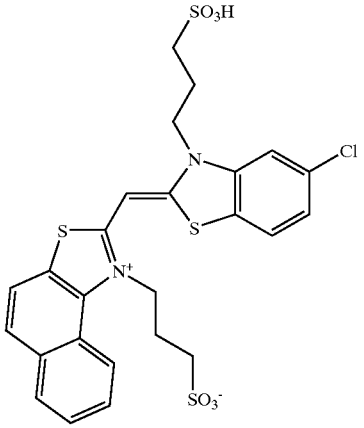
GSD-1
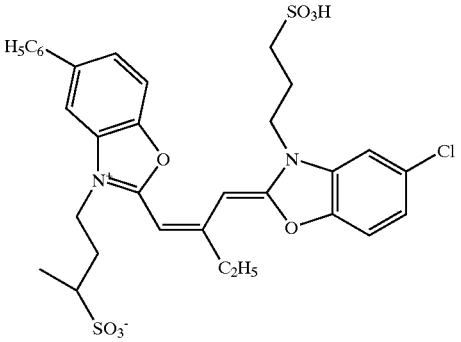

-continued
GSD-2
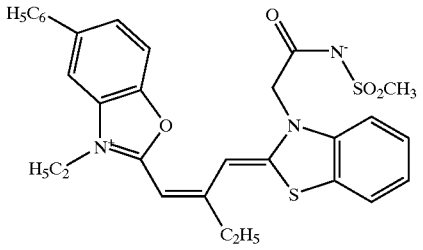
GSD-3
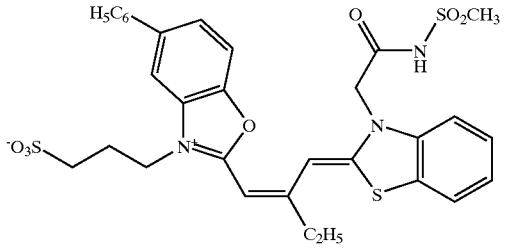
RSD-1
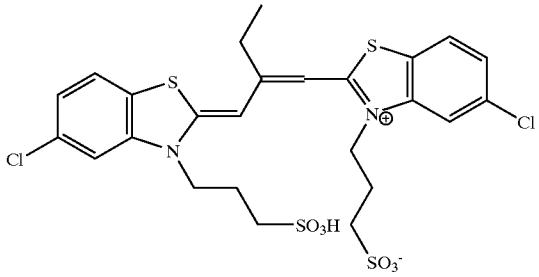
RSD-2
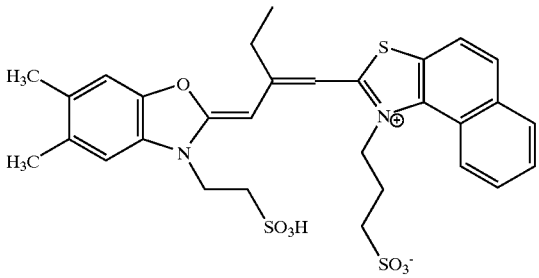
RSD-3
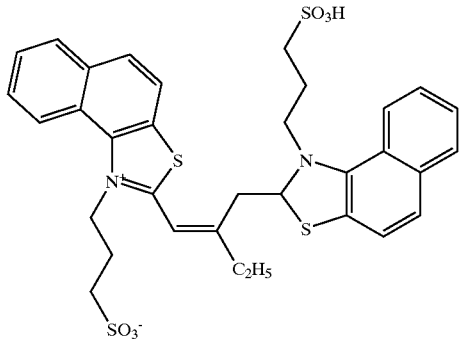

-continued

RSD-4

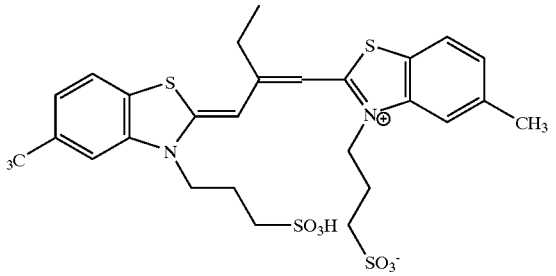

OxDS-1

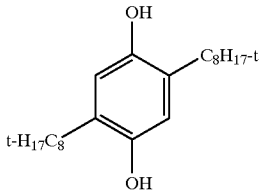

OxDS-2

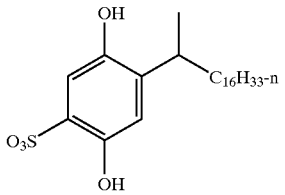

YFD-1

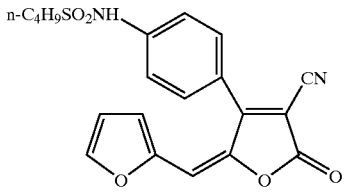

ADD-1

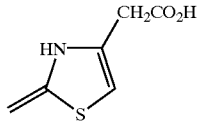

ADD-2

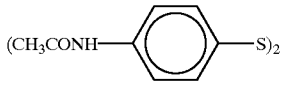

ADD-3

Sodium Hexametaphosphate

ADD-6

4-Hydroxy-6-methyl-1,3,3a,7-tetrazaindene

ADD-7

$Au_2S$

ADD-8

MnSO4

ADD-9

$PdCl_4^{2-}\cdot(NH_4^+)_2$

The invention has been described in detail with particular reference to certain preferred embodiments thereof, but it will be understood that variations and modifications can be effected within the spirit and scope of the invention.

What is claimed is:

1. A multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said red-sensitive or green-sensitive layers comprises a fragmentable electron donating compound of the formula: X—Y' or a compound which contains a moiety of the formula —X—Y'; wherein the speed gain deriving from addition of said compound to said layer is less than or equal to 0.05 log sensitivity units and wherein X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V;
2) the oxidized form of X—Y' undergoes a bond cleavage reaction to give the radical $X^{\cdot}$ and the leaving fragment Y'; and
3) the radical $X^{\cdot}$ has an oxidation potential $\leqq -0.7$V.

2. A photographic element according to claim 1, wherein the fragmentable electron donating compound comprises a silver halide adsorptive group or a sensitizing dye.

3. A photographic element according to claim 1, wherein wherein the blue sensitive emulsion layer contains a fragmentable two electron donor.

4. A photographic element according to claim 1, wherein the fragmentable electron donating compound is present in an amount of $1\times10^{-9}$ mole to about 0.1 mole per mole of silver in an emulsion layer.

5. A photographic element according to claim 4, wherein the fragmentable electron donating compound is present in an amount of $5\times10^{-9}$ mole to about 0.01 mole per mole of silver in an emulsion layer.

6. A photographic element according to claim 1, wherein X is of structure (I):

(I)

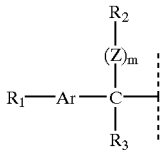

$R_1$=R, carboxyl, amide, sulfonamide, halogen, $NR_2$, $(OH)_n$, $(OR')_n$, or $(SR)_n$;

R'=alkyl or substituted alkyl, n=1–3;

$R_2$=R, Ar';

$R_3$=R, Ar';

$R_2$ and $R_3$ together can form 5- to 8-wherein:

m=0, 1;

Z=O, S, Se, Te;

$R_2$ and Ar=can be linked to form 5- to 8-membered ring;

$R_3$ and Ar=can be linked to form 5- to 8-membered ring;

Ar'=aryl groupor heterocyclic group;

and

R=a hydrogen atom or an unsubstituted or substituted alkyl group.

7. A photographic element according to claim 6, wherein the compound of Structure (I) is selected from:

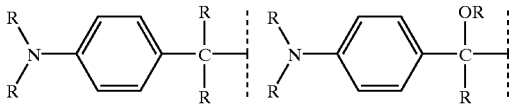

-continued

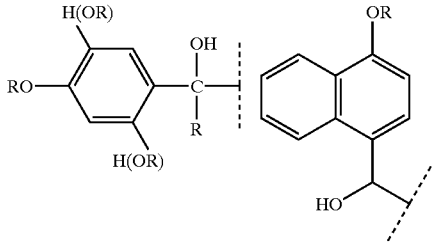

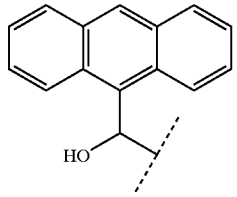

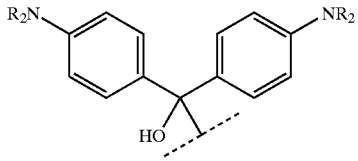

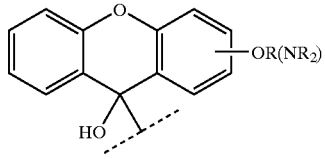

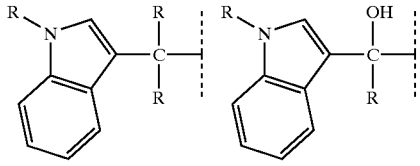

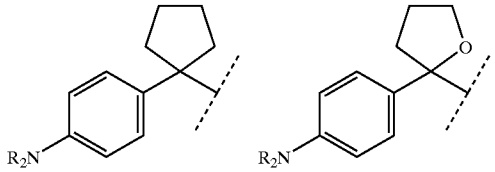

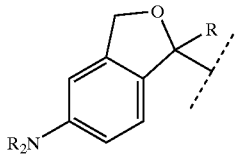

wherein each R is independently a hydrogen atom or a substituted or unsubstituted alkyl group.

8. A photographic element according to claim 1, wherein X is a compound of structure (II):

(II)

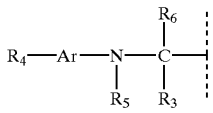

wherein:

Ar=aryl group or heterocyclic group $R_4$=a substituent having a Hammett sigma value of −1 to +1, $R_5$=R or Ar'

$R_6$ and $R_7$=R or Ar'

$R_5$ and Ar=can be linked to form 5- to 8-membered ring;

$R_6$ and Ar=can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar'=aryl group or heterocyclic group;

and

R=hydrogen atom or an unsubstituted or substituted alkyl group.

9. A photographic element according to claim 8, wherein X is selected from:

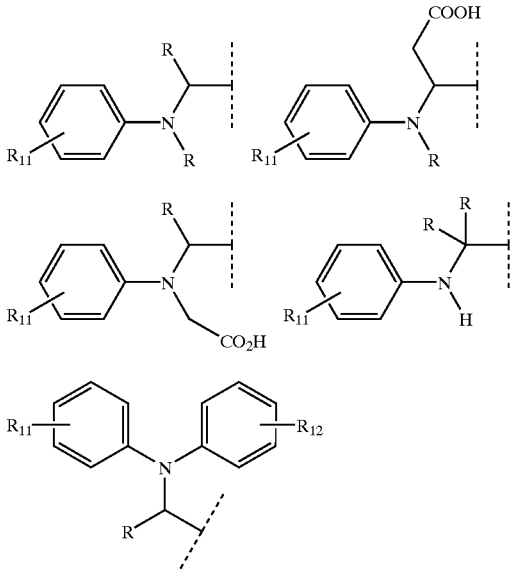

$R_{11}$ and $R_{12}$ = { H, alkyl, alkoxy, alkylthio, halo, carbamoyl; carboxyl, amido, formyl, sulfonyl, sulfonamido, nitrile }

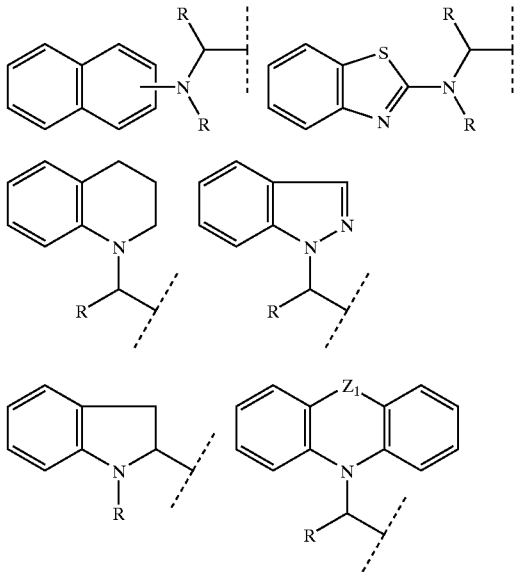

$Z_1$=a covalent bond, S, O, Se, NR, $CR_2$, CR═CR, or $CH_2CH_2$;

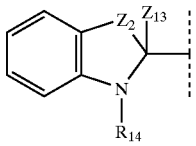

$Z_2$=S, O, Se, NR, $CR_2$, CR═CR, $R_{13}$, =alkyl, substituted alkyl or aryl, and $R_{14}$=H, alkyl substituted alkyl or aryl.

10. A photographic element according to claim 1, wherein X is a compound of structure (III):

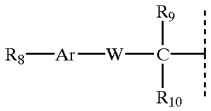

(III)

wherein:

W=O, S, Se;

Ar=aryl group or heterocyclic group;

$R_8$=R, carboxyl, $NR_2$, $(OR)_n$, or $(SR)_n$(n=1–3);

$R_9$ and $R_{10}$=R, Ar';

$R_9$ and Ar=can be linked to form 5- to 8-membered ring;

Ar'=aryl group or heterocyclic group;

and

R=a hydrogen atom or an unsubstituted or substituted alkyl group.

11. A photographic element according to claim 10, wherein X is selected from:

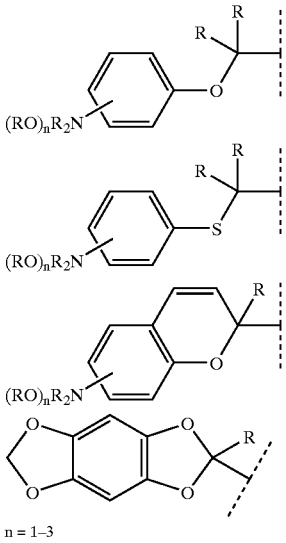

n = 1–3

12. A photographic element according to claim 1, wherein X is of structure (IV):

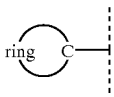

(IV)

wherein:

"ring" represents a substituted or unsubstituted 5-, 6- or 7-membered unsaturated ring.

13. A photographic element according to claim 12, wherein X is selected from:

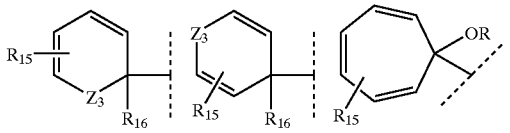

$Z_3$=O, S, Se, NR $R_{15}$=R, OR, $NR_2$ $R_{16}$=alkyl, substituted alkyl.

14. A photographic element according to claim 1, wherein Y' is:

(1) X', where X' is an X group as defined in structures I-IV and may be the same as or different from the X group to which it is attached (2) —$COO^-$ (3) —$M(R')_3$ where M=Si, Sn or Ge; and R'=alkyl or substituted alkyl (4) —$B^-(Ar'')_3$ where Ar''=aryl or substituted aryl (5) —H.

15. A photographic element according to claim 1, wherein the fragmentable electron donor compound is selected from compounds of the formulae:

$Z—(L—X—Y')_k$ $A—(L—X—Y')_k$ $(A—L)_k—X—Y'$

Q—X—Y'

$A—(X—Y')_k$ $(A)_k—X—Y'$ $Z—(X—Y')_k$ or $(Z)_k—X—Y'$ wherein:

Z is a light absorbing group;

k is 1 or 2;

A is a silver halide adsorptive group,

L represents a linking group containing at least one C, N, S, P or O atom; and

Q represents the atoms necessary to form a chromophore comprising an amidinium-ion, a carboxyl-ion or dipolar-amidic chromopholic system when conjugated with X—Y'.

16. A photographic element according to claim 15, wherein the fragmentable electron donor compound is of the formula:

$Z—(L—X—Y')_k$ $Z—(X—Y')_k$ or $(Z)_k—X—Y'$ wherein Z is derived from a cyanine dye, complex cyanine dye, merocyanine dye, complex merocyanine dye, homopolar cyanine dye, styryl dye, oxonol dye, hemioxonol dye, or hemicyanine dye.

17. A photographic element according to claim 15, wherein the fragmentable electron donor compound is of the formula:

$A—(L—X—Y')_k$ $(A—L)_k—X—Y'$ $A—(X—Y')_k$ or $(A)_k—X—Y'$ wherein: A is a silver-ion ligand moiety or a cationic surfactant moiety.

18. A photographic element according to claim 17, wherein A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

19. A photographic element according to claim 15, wherein the fragmentable electron donor compound is of the formula:

Q—X—Y' wherein Q represents a chromophoric system comprisisng a cyanine, complex cyanine, hemicyanine, merocyanine, or complex merocyanine dye.

20. A photographic element according to claim 1, wherein the fragmentable electron donor comprises a compound of formula (a), (b) or (c):

$$\Delta\text{-}(t)_m—XY' \quad (a)$$

$$XY'(t)_m\text{-}\Delta \quad (b)$$

$$\Delta\text{-}(t)_m—XY'\text{-}(t)_m\text{-}\Delta \quad (c)$$

wherein Δ is protective group that is capable of being eliminated in the coating environment, t is a timing group, m is an integer from 0 to 3.

21. A photographic element according to claim 1, wherein the fragemntable electron donor compound is selected from the group consisting of:

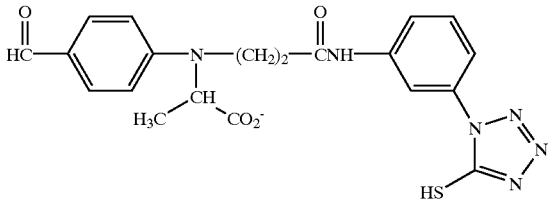
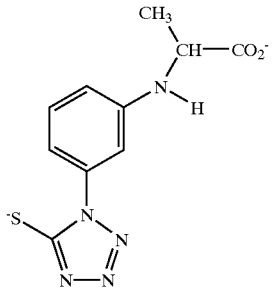
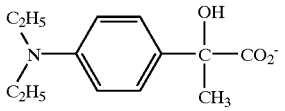
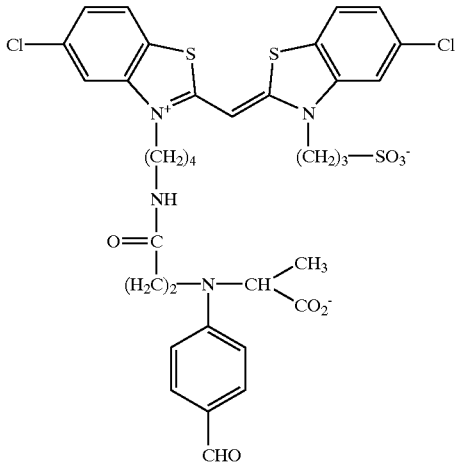
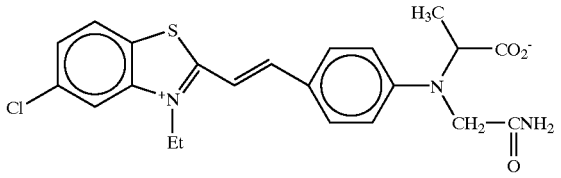
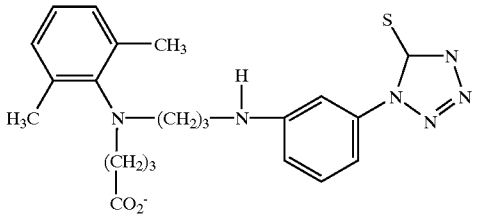
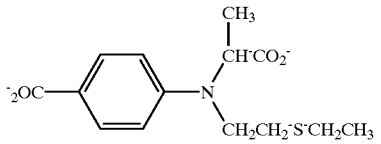

-continued
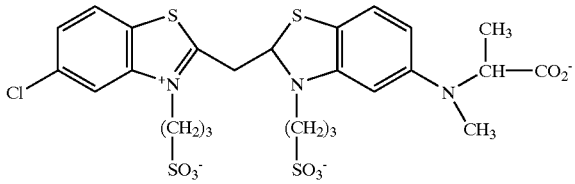
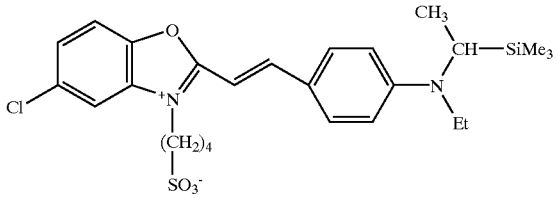
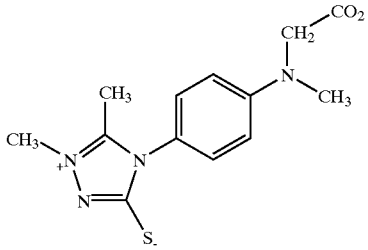
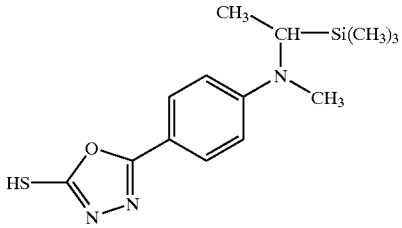
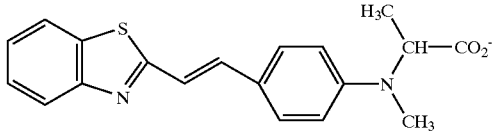
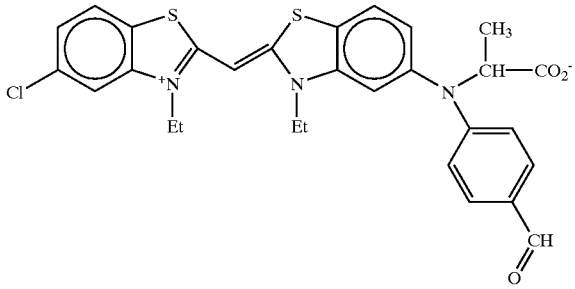
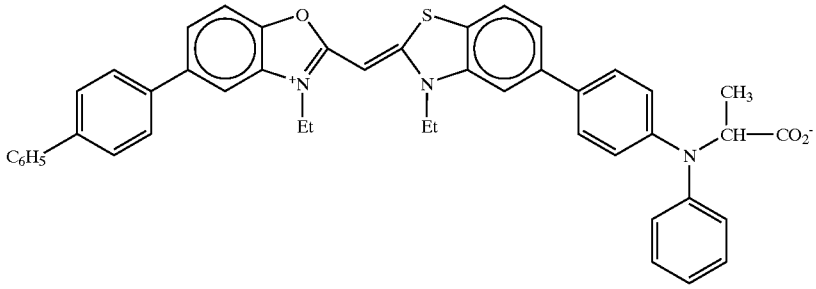

-continued
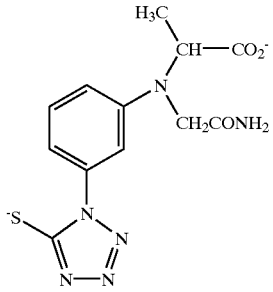
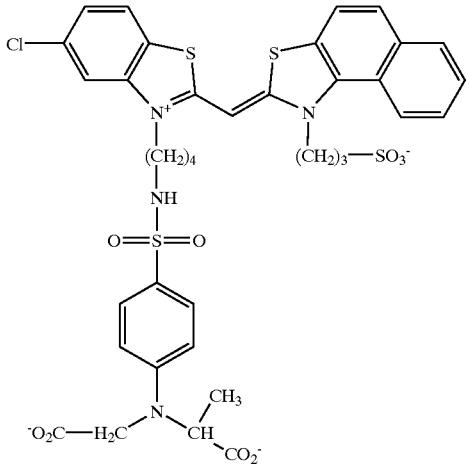
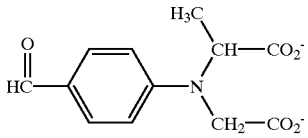
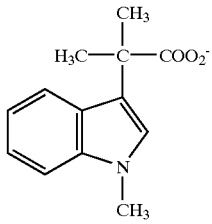
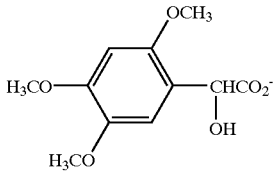
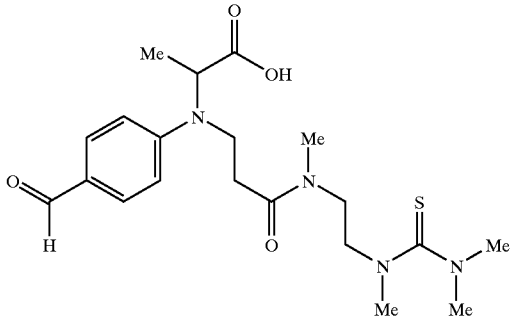

-continued

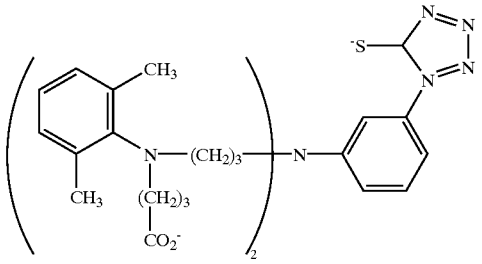

and

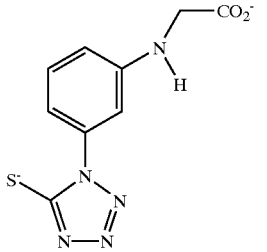

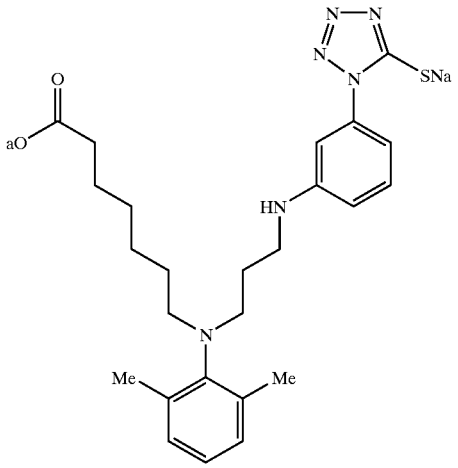

22. A method of improving the latent image keeping of a multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein for at least one of said red-sensitive or green-sensitive layers, said method comprises adding a fragmentable electron donating compound of the formula: X—Y' or a compound which contains a moiety of the formula —X—Y', in an amount sufficient to improve the latent image keeping but insufficient to impart a speed gain deriving from addition of said compound to said layer of more than 0.05 log sensitivity units and wherein X is an electron donor moiety, Y' is a leaving proton H or a leaving group Y, with the proviso that if Y' is a proton, a base, $\beta^-$, is present in the emulsion layer, and wherein:

1) X—Y' has an oxidation potential between 0 and about 1.4 V;
2) the oxidized form of X—Y' undergoes a bond cleavage reaction to give the radical $X^{\cdot}$ and the leaving fragment Y'; and
3) the radical $X^{\cdot}$ has an oxidation potential $\leqq -0.7$V.

23. A method according to claim 22, wherein the fragmentable electron donating compound is present in an amount of $1\times10^{-9}$ mole to about 0.1 mole per mole of silver in an emulsion layer.

24. A method according to claim 23, wherein the fragmentable electron donating compound is present in an amount of $5\times10^{-9}$ mole to about 0.01 mole per mole of silver in an emulsion layer.

* * * * *